US009938702B2

(12) United States Patent
Liu et al.

(10) Patent No.: US 9,938,702 B2
(45) Date of Patent: Apr. 10, 2018

(54) WATER TANK-LESS TOILET FLUSHING SYSTEM WITH CONTROL SYSTEM THEREOF

(71) Applicant: MEGMEET Electric Co., Ltd. of Shenzhen, Shenzhen, Guangdong (CN)

(72) Inventors: Yong Liu, Shenzhen (CN); Pugen Lin, Shenzhen (CN); Yingjun Zhao, Shenzhen (CN); Zhaoyuan Zeng, Shenzhen (CN); Zhanfeng Liu, Shenzhen (CN)

(73) Assignee: MEGMEET Electric Co., Ltd. Of Shenzhen, Guangdong (CN)

( * ) Notice: Subject to any disclaimer, the term of this patent is extended or adjusted under 35 U.S.C. 154(b) by 460 days.

(21) Appl. No.: 14/533,049

(22) Filed: Nov. 4, 2014

(65) Prior Publication Data

US 2016/0122989 A1 May 5, 2016

(51) Int. Cl.

| | |
|---|---|
| ***E03D 11/18*** | (2006.01) |
| ***E03D 5/10*** | (2006.01) |
| ***E03C 1/10*** | (2006.01) |
| ***E03D 3/00*** | (2006.01) |

(52) U.S. Cl.
CPC ..... *E03D 5/10* (2013.01); *E03C 1/108* (2013.01); *E03D 3/00* (2013.01); *E03D 2201/30* (2013.01)

(58) Field of Classification Search
USPC ..... 4/422
See application file for complete search history.

(56) References Cited

U.S. PATENT DOCUMENTS 6,675,399 B1 * 1/2004 Tomita ..... E03D 3/00 4/420.2

* cited by examiner

*Primary Examiner* — Lauren Crane
(74) *Attorney, Agent, or Firm* — Raymond Y. Chan; David and Raymond Patent Firm

(57) ABSTRACT

A water tank-less toilet flushing system includes a toilet bowl and a control system which includes a flush valve located higher than a top surface of the toilet bowl and a check valve operatively linked to the flush valve. When the flush valve is opened, the check valve is closed due to a water pressure for enabling the water to flush the toilet bowl. When the flush valve is closed, the check valve is opened for communicating an interior of the flush valve with an ambient atmosphere to prevent water in the toilet bowl to be backflow to the flush valve.

20 Claims, 16 Drawing Sheets

WATER TANK-LESS TOILET FLUSHING SYSTEM WITH CONTROL SYSTEM THEREOF

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a toilet system, and more particular to a water tank-less toilet flushing system with a control system thereof, which are able to prevent the siphon action generated within the toilet structure.

Description of Related Arts

A conventional toilet flushing system comprises a water tank connected to a water inlet pipe for storing a predetermined volume of clean water to flush a toilet bowl. During the flushing operation, the clean water is discharged from the water tank to the toilet bowl, such that sewage and fecal debris in the toilet bowl are flushed and drained through a sewer draining pipe. However, the volume of clean water stored in the water tank is constant that cannot be adjusted. In other words, the fixed volume of clean water is used for every flushing operation. Furthermore, it is time consuming to fully refill the clean water in the water tank after every flushing operation is completed. As a result, the time interval between two consecutive flushing operations is the time for fully refilling the clean water into the water tank. Due to the relatively large amount of fecal debris, multiple flushing operations are required for completely flushing out of the toilet bowl. In other words, it is a time wasting to wait for the clean water to be fully refilled in the water tank for next flushing operation. Likewise, it is water wasting that same amount volume of clean water will be used in one single flushing operation to flush relatively amount of fecal debris in the toilet bowl. In addition, the water tank will take up additional space for the toilet flushing system and the clean water in the water tank has an unpleasant odor over a period of unused storage time so as to pollute the air in the restroom.

An improved tank-less toilet flushing system has advantages of minimizing tank space and conserving the water resource comparing to the conventional toilet flushing system with the water tank. However, such tank-less toilet flushing system still has several drawbacks. Accordingly, the tank-less toilet flushing system comprises a flushing pipe located at an upper portion of the toilet bowl and an injection pipe extended to a bottom siphon pool of the toilet bowl, wherein the injection pipe is connected to a water pipe via an electromagnetic flush valve. Accordingly, the operation of the flush valve is controlled by a controlling button of a controller so as to control the flush valve between an opened state and a closed state. At normal condition that no water is discharged to the toilet flushing system, the water pipe is remained at a negative pressure condition. Once the flush valve is opened, the sewage and bacteria at the siphon pool will backflow to the water pipe due to the siphon action. As a result, the water source will be polluted through the water pipe. In addition, the installation location of the flush valve is below the top surface of the toilet bowl. When the toilet bowl is clogged, the water level in the toilet bowl will be gradually increased during flushing operation. Once the water level in the toilet bowl is higher than the location of the flush valve, the sewage within the toilet bowl will backflow to the flush valve and will directly contact with the water outlet of the flush valve as a result in water pollution.

SUMMARY OF THE PRESENT INVENTION

A main object of the present invention is to provide a water tank-less toilet flushing system, wherein a check valve is opened when water is stopped supplying to the water pipe to avoid siphon action in the flushing system. In other words, the negative pressure at the water pipe will not generate the siphon action to the flushing system, such that the sewage within the siphon pool and the sewer gas within the toilet bowl will not backflow to the water pipe, so as to prevent water pollution therein and prevent any bacteria entering into the water pipe.

Accordingly, in order to accomplish the above mentioned object, the present invention provides a water tank-less toilet flushing system, comprising a flush valve having an inlet linked to a water pipe and an outlet located higher than a water level of a siphon pool of a toilet bowl, and a check valve is provided at either the inlet or outlet of the flush valve for communicating with ambient atmosphere. When there is no water pressure at the inlet or outlet of the flush valve, the check valve is opened to allow the inlet or outlet of the flush valve to communicate with the ambient atmosphere. In other words, when there is water pressure at either the inlet or outlet of the flush valve, the check valve will be closed to from a closed water channel.

Accordingly, the check valve, which is a pressure-controlled check valve, is installed within an outlet pipe of the flush valve, wherein the check valve is closed by positive pressure at the outlet pipe and is opened by zero pressure or negative pressure at the outlet pipe. When the check valve is opened, the outlet pipe of the flush valve will communicate with the ambient atmosphere through the pressure-controlled check valve.

Accordingly, the pressure-controlled check valve can be a float-controlled valve or a gravity-controlled valve. The gravity-controlled check valve comprises a valve seat and a valve plug, wherein the valve seat is positioned above the valve plug, such that the valve plug is pushed upwardly by the water to seal and close the valve seat and is dropped downwardly by gravity to open up the valve seat when there is no water pressure.

Accordingly, the pressure-controlled check valve can be a spring-loaded check valve which comprises an air intake valve seat, a control valve body, and a compression spring, wherein the control valve core is pushed by the compression spring to move away from the air intake valve seat and the valve body is pushed by the water pressure to move towards the air intake valve seat to close and seal the air intake valve seat.

Accordingly, the water pipe comprises an air intake hole and an air intake valve seat, wherein the air intake valve seat comprises an air inner slot adapted to communicate with the atmosphere through the air intake hole. The control valve body comprises a valve flap, wherein the left end of the compression spring is supported by a bottom face of the air inner slot of the air intake valve seat, and the right end of the compression spring is supported by the valve flap of the control valve body. When the compression spring is compressed, the air inner slot of the air intake valve seat is blocked and sealed by a rear end of the valve flap.

Accordingly, the water outlet comprises an outlet valve seat, wherein the outlet valve seat is coaxial with the air intake valve seat of the first outlet pipe, such that when the compression spring is expanded, the front end of the valve flap is sealed with the water outlet.

Accordingly, the outlet pipe is a vertical pipe, wherein an upper end of the water outlet pipe is fixed on the universal valve casing. The intake valve seat is provided at the top portion of the water outlet pipe. And, the axis of the outlet pipe seat and the axis of the air intake valve seat are perpendicular with the axis of the water outlet pipe.

Accordingly, the control valve core comprises a hollow front valve stem and a hollow rear valve stem, wherein the front valve stem is loosely coupled at a valve inner hole of the outlet valve seat, and the rear valve stem is loosely coupled at the air inner hole of the air intake valve seat. The compression spring is installed at an inner hole of the rear valve stem. The rear valve stem comprises a plurality of rear valve through holes communicating the interior of the rear valve stem with the exterior thereof, and the front valve stem comprises a plurality of front valve through holes communicating the inner holes of the front valve stem with the exterior thereof.

Accordingly, the pressure-controlled check valve comprises a front sealing ring coupled at a front ring groove formed at a root portion of the front valve stem and a rear sealing ring coupled at a rear ring groove formed at a root portion of the rear valve stem. When the compression spring is expanded, the front sealing ring is sealed at the water outlet valve seat, and when the compression spring is compressed, the rear sealing ring is sealed by the air intake valve seat.

Accordingly, the flush valve is a solenoid valve and is located higher than the top surface of the toilet bowl. In particular, the flush valve comprises first and second solenoid valves, wherein an outlet of the first solenoid valve is connected to the flush pipe of the toilet bowl, and an outlet of the second solenoid valve is connected to the injection port of the toilet bowl. The first pressure-controlled check valve is installed at the outlet of the first solenoid valve, and the second pressure-controlled valve is installed at the outlet of the second solenoid valve.

Accordingly, when the negative pressure generates at the outlet or inlet of the flush valve, the outlet or inlet of the flush valve will automatically communicate with the ambient atmosphere to form air isolated zone. While the flush valve is opened as well as there is no water supplied in the water pipe, the negative pressure within the water pipe will not be transferred to the outlet of the flush valve. As a result, no siphon action will be occurred to force the sewage within the siphon pool and the sewer gas within the toilet bowl to be backflow to the water pipe so as to prevent water pollution therein.

In accordance with another aspect of the invention, the present invention comprises a control system of a water tank-less toilet flushing system, wherein the control system comprises a power source, a controller, a water pressure sensor, and a flush valve. The inlet of the flush valve is linked to the water pipe while the outlet of the flush valve is linked to the toilet bowl of the flushing system. A pressure input of the water pressure sensor is linked to the water pipe to detect the water pressure therein. A pressure signal output terminal of the water pressure sensor is operatively linked to a water pressure signal input terminal of the controller.

The control system further comprises an electro-controlled valve having an inlet communicating with ambient atmosphere and an outlet linked to the outlet of the flush valve.

Preferably, there are two flush valves and two electro-controlled valves. The first and second electro-controlled valves communicate with the ambient atmosphere respectively. The outlet of the first flush valve is linked to the outlet of the first electro-controlled valve. The outlet of the second flush valve is linked to the outlet of the second electro-controlled valve. The outlet of the first flush valve is also linked to the flush port of the toilet bowl. The outlet of the second flush valve is also linked to the injection port of the toilet bowl.

Alternatively, the control system further comprises an electro-controlled valve having an inlet communicating with ambient atmosphere and an outlet linked to the water pipe through the throttle orifice.

Accordingly, the flush valve is located above the top surface of the toilet bowl.

When there is no water supplying to the water pipe, the water pressure sensor 4 will sent a water pressure signal to the controller. In this condition, the controller will not able to move the flush valve in the opened condition. Since the flush valve cannot be moved in the opened condition, the negative pressure at the water pipe will not create any siphon action that the sewage within the siphon pool and the sewer gas within the toilet bowl will backflow to the water pipe, so as to prevent water pollution within the water pipe.

Alternatively, the control system comprises a power source, a controller, a pressure-controlled switch, and a flush valve. The inlet of the flush valve is linked to the water pipe while the outlet of the flush valve is linked to the toilet bowl of the flushing system. A pressure input of the pressure-controlled switch is linked to the water pipe to detect the water pressure therein. A main signal terminal of the pressure-controlled switch is operatively linked to a control circuit in series connection.

Accordingly, the main signal terminal of the pressure-controlled switch is electrically linked to an electric supplying circuit in series connection, wherein the electric supplying circuit is electrically linked between the power source and the controller.

Accordingly, the flush valve comprises a first solenoid valve and the second solenoid valve. The pressure-controlled switch 4 has a first main signal terminal and a second main signal terminal. The first main signal terminal of the pressure-controlled switch is electrically linked to a first control circuit in series connection, wherein the first control circuit is electrically linked between the first solenoid valve and the controller. The second main signal terminal of the pressure-controlled switch is electrically linked to a second control circuit in series connection, wherein the second control circuit is electrically linked between the second solenoid valve and the controller. In addition, an outlet of the first solenoid valve is operatively linked to the flush port and the outlet of the second solenoid valve is operatively linked to the injection port.

Alternatively, the main signal terminal of the pressure-controlled switch is electrically linked to a control circuit in series connection, wherein the control circuit is electrically linked between the controlling switch and the controller.

Accordingly, the flush valve is located higher than the top surface of the toilet bowl.

When there is no water in the water pipe to create a negative pressure therewithin, the main signal terminal of the pressure-controlled switch is opened, so as to cut off the electrical connection between the solenoid valve and the controller. So, the control circuit cannot electrically connect to the solenoid valve. In this condition, the solenoid valve cannot be moved to its opened condition. As a result, the sewage within the siphon pool and the sewer gas within the toilet bowl cannot backflow to the water pipe due to the siphon action, so as to prevent water pollution within the water pipe Additional advantages and features of the invention will become apparent from the description which follows, and may be realized by means of the instrumentalities and combinations particular point out in the appended claims.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
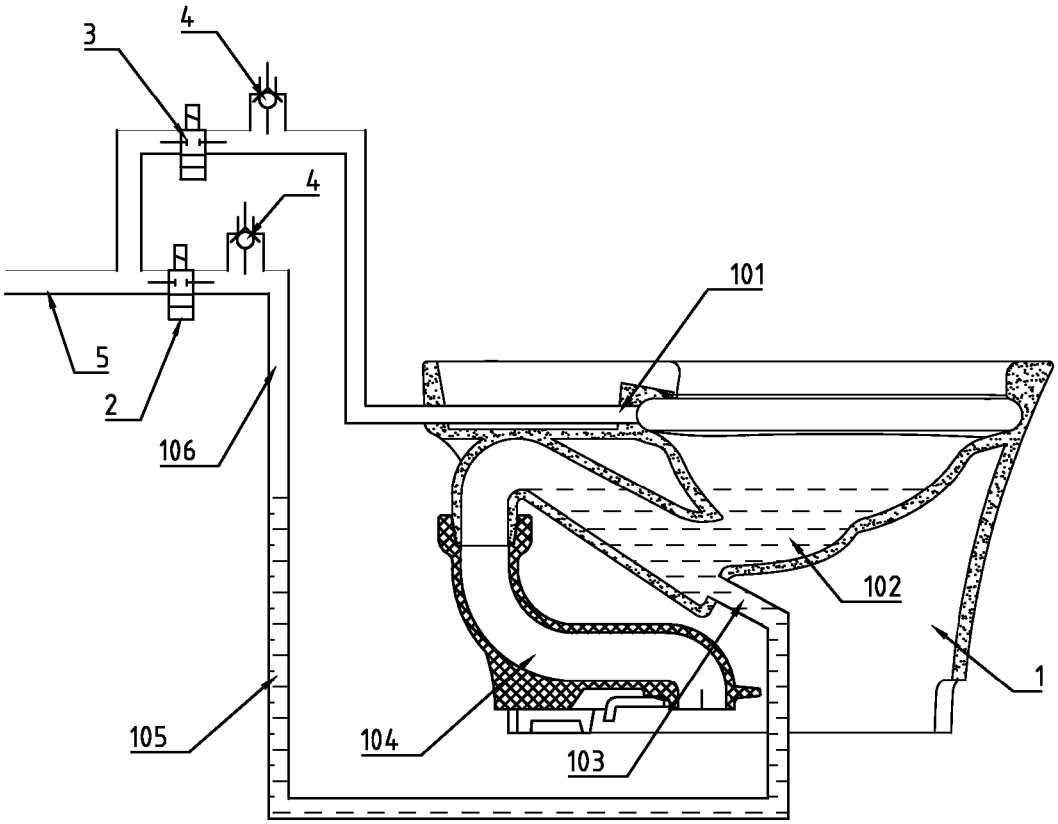
FIG. 1 is a schematic view of a water tank-less toilet flushing system according to a first preferred embodiment of the present invention.

Referring to FIG. 1 of the drawings, a water tank-less toilet flushing system according to a first preferred embodiment of the present invention is illustrated, wherein the water tank-less toilet flushing system comprises a flushing system and a control system. The control system comprises a first solenoid valve 2 and a second solenoid valve 3, wherein inlets of the first solenoid valve 2 and the second solenoid vale 3 are connected to a water pipe 5.

The flushing system comprises a toilet bowl 1 having a flush port 101 connected to the water pipe 5 for introducing water to flush the toilet pool 1, a siphon pool 102 at a bottom portion of the toilet bowl 1 to maintain a predetermined water level therein as a barrier to sewer gas entering and as a receptacle for waste, an injection port 103 located at the bottom portion of the toilet bowl 1 toward a sewage discharging direction of the siphon pool 102, a drain port 104 located at a rear portion of the siphon pool 102 to communicate with the siphon pool 102. In addition, an outlet of the first solenoid valve 2 is operatively linked to the flush port 101 and the outlet of the second solenoid valve 3 is operatively linked to the injection port 103.

The first solenoid valve 2 and the second solenoid valve 3 are located higher than the top surface of the toilet bowl 1. Therefore, in case of the toilet bowl 1 being clogged, the higher water level in the toilet bowl 1 during flushing operation will not cause the sewage in the toilet bowl 1 to be backflow to and pollute the first solenoid valve 2 and the second solenoid valve 3. Accordingly, a signal input terminal of each of the first solenoid valve 2 and the second solenoid valve 3 is operatively linked to a controller of the control system.

The control system further comprises at least a pressure-controlled check valve 4, preferably two pressure-controlled check valves. Accordingly, the pressure-controlled check valve 4 can be a positive pressure-controlled check valve, negative pressure-controlled check valve, or zero pressure-controlled check valve. In particular, the pressure-controlled check valve 4 can be a float-controlled check valve, gravity-controlled check valve, or a spring-loaded check valve. It is worth mentioning that the pressure-controlled check valve 4 is incorporated with the first and second solenoid valves 2, 3. Preferably, two pressure-controlled check valves 4 are incorporated with the first and second solenoid valves 2, 3 respectively. When the first and second solenoid valves 2, 3 are opened for start the flushing operation, the pressure-controlled check valves 4 are closed due to the water pressure generated from the first and second solenoid valves 2, 3. In other words, outlets of the first and second solenoid valves 2, 3 form closed flush channels. When the outlets of the first and second solenoid valves 2, 3 are at zero or negative pressure after the first and second solenoid valves 2, 3 are closed, the pressure-controlled check valve 4 is opened. As a result, the water outlet pipes of the first and second solenoid valves 2, 3 form opened flush channels to communicate with the ambient atmosphere. Since the first and second solenoid valves 2, 3 are located higher than the top surface of the toilet bowl 1, the water level at a flush pipe 105 will return to the lower level to form an air isolated zone 106 at the flush pipe 105. It is worth mentioning that the flush pipe 105 is operatively linked between the first solenoid valve 2 and the injection port 103 of the toilet bowl 1 and the air isolated zone 106 is formed within the flush pipe 105 below the first solenoid valve 2.

It is worth mentioning that when there is no water entering to the water pipe 5, and the first and second solenoid valve 2, 3 are opened, the water pipe 5 is at a negative pressure condition. Since the outlets of the first and second solenoid valves 2, 3 are opened to communicate with the ambient atmosphere through the pressure-controlled check valves 4, the sewage at the siphon pool 102 and the sewer gas at the flush port 101 will not back flow to the water pipe 5 due to the siphon action, so as to prevent water pollution at the water pipe 5.

Figure 2:
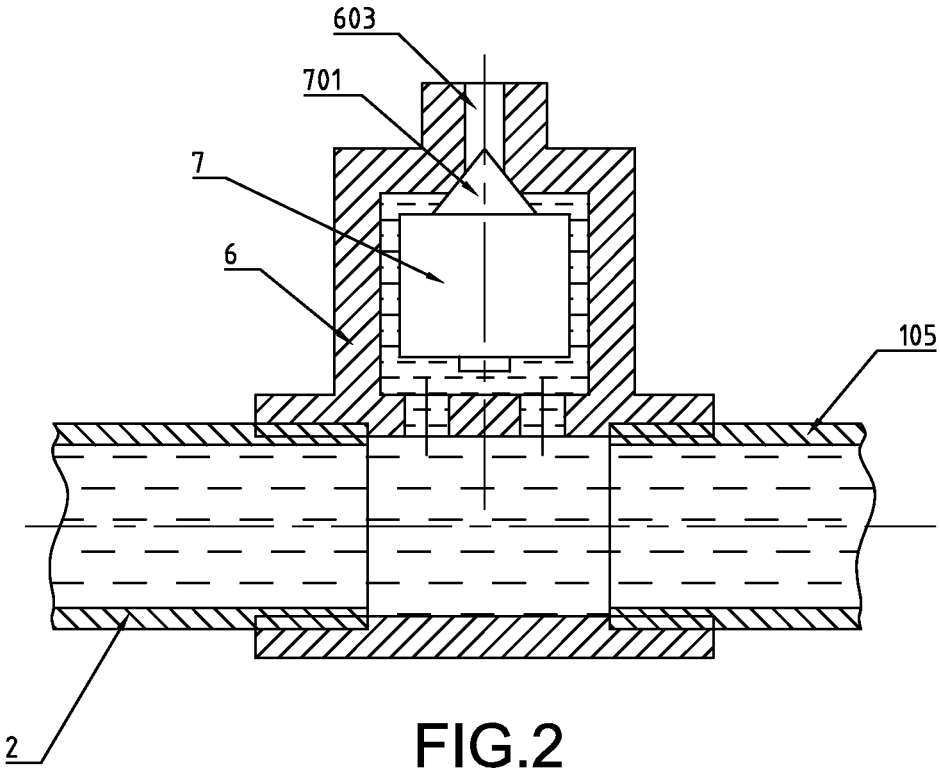
FIG. 2 is a sectional view of a pressure-controlled check valve of the water tank-less toilet flushing system according to the first preferred embodiment of the present invention, illustrating the pressure-controlled check valve as a float-controlled check valve at a closed condition.
Figure 3:
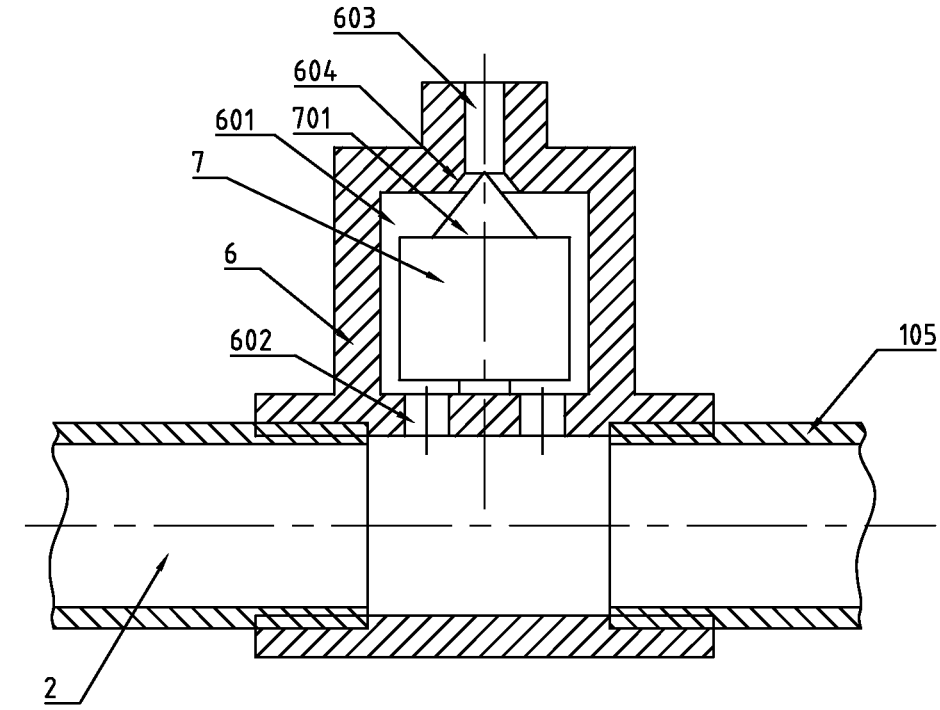
FIG. 3 is a sectional view of a pressure-controlled check valve of the water tank-less toilet flushing system according to the first preferred embodiment of the present invention, illustrating the pressure-controlled check valve as a float-controlled check valve at an opened condition.

As shown in FIGS. 2 and 3, the pressure-controlled check valve 4 is embodied as a float-controlled check valve which comprises an outer casing 6 and a floater 7. The inlet of the outer casing 6 is operatively linked to the outlet of the first solenoid valve 2. The outlet of the outer casing 6 is operatively linked to the flush pipe 105 to the injection port 103 of the toilet bowl 1. The outer casing 6 comprises a floating chamber 601, one or more through apertures 602, and an air inlet aperture 603 communicating with the floating chamber 601. The floating chamber 601 communicates with the outlet of the first solenoid valve 2 through the through apertures 602. The pressure-controlled check valve 4 further comprises a valve seat 604 provided at a bottom end of the air inlet aperture 603. Accordingly, the floater 7, having an upper valve needle 701, is disposed in the floating chamber 601 of the outer casing 6.

As shown in FIG. 2, when the first solenoid valve 2 is opened for releasing the water, the water passes through the through apertures 602 into the floating chamber 601 to lift the floater 7 upwardly in the floating chamber 601, such that the valve seat 604 is sealed and closed by the valve needle 701 of the floater 7 to close the float-controlled check valve. As shown in FIG. 3, when the first solenoid valve 2 is closed, the flush pipe 5 is at a negative pressure condition for releasing water in the floating chamber 601 in such a manner that the floater 7 will drop down to move the valve needle 701 away from the valve seat 604 so as to open the float-controlled check valve. In addition, the flush pipe 105 communicates with the ambient atmosphere through the air inlet aperture 603. As shown in FIG. 1, the water level of the flush pipe 105 is dropped to form the air isolated zone 106.

Figure 4:
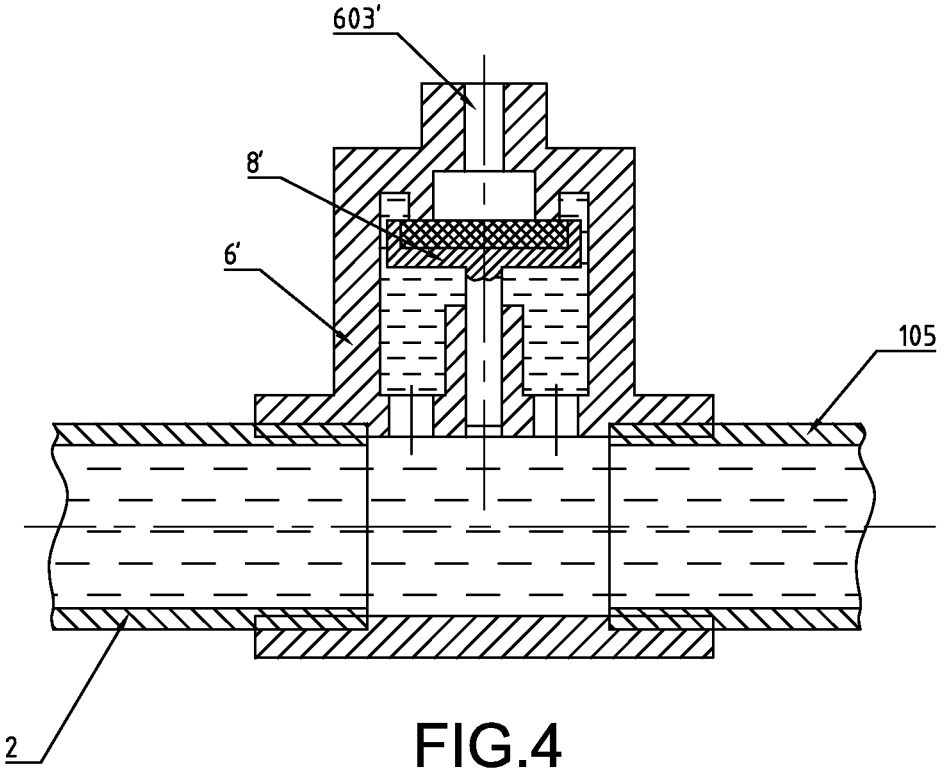
FIG. 4 is a sectional view of a pressure-controlled check valve of the water tank-less toilet flushing system according to the first preferred embodiment of the present invention, illustrating the pressure-controlled check valve as a gravity-controlled check valve at a closed condition.
Figure 5:
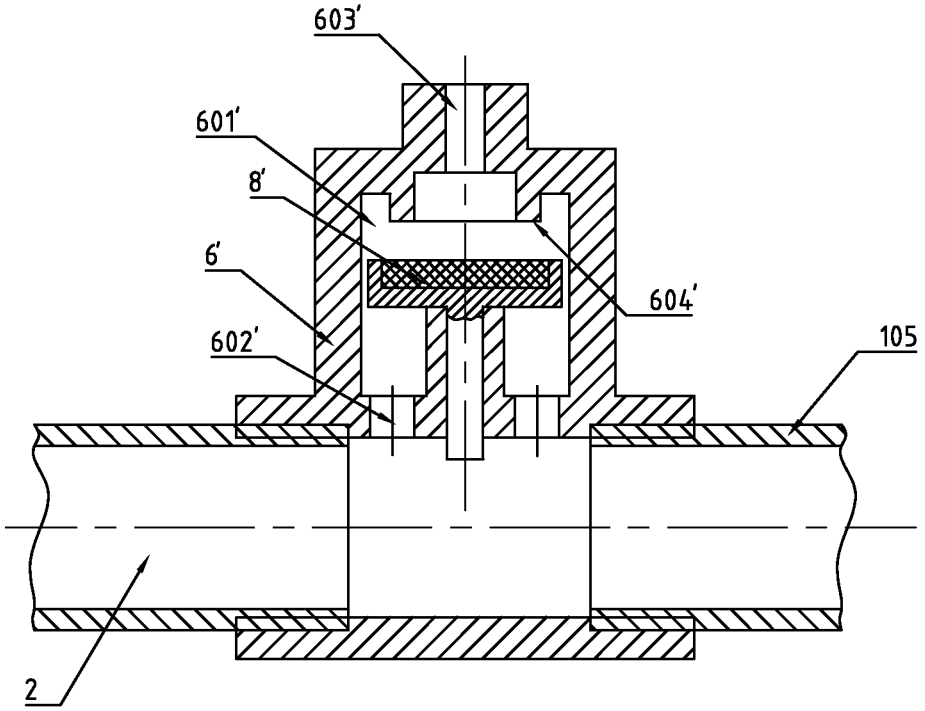
FIG. 5 is a sectional view of a pressure-controlled check valve of the water tank-less toilet flushing system according to the first preferred embodiment of the present invention, illustrating the pressure-controlled check valve as a gravity-controlled check valve at an opened condition.

Referring to FIGS. 4 and 5 of the drawings, the pressure-controlled check valve 4 is embodied as a gravity-controlled check valve, which comprises an outer casing 6' and a valve plug 8'. The inlet of the outer casing 6' is operatively linked to the outlet of the first solenoid valve 2. The outlet of the outer casing 6' is operatively linked to the flush pipe 105 to the injection port 103 of the toilet bowl 1. The outer casing 6' comprises a valve chamber 601', one or more through apertures 602', and an air inlet aperture 603' communicating with the valve chamber 601'. The valve chamber 601' communicates with the outlet of the first solenoid valve 2 through the through apertures 602'. The pressure-controlled check valve 4 further comprises a valve seat 604' provided at a bottom end of the air inlet aperture 603'.

Accordingly, the valve plug 8', having a T-shape, is disposed in the valve chamber 601' of the outer casing 6', wherein the valve seat 604' is located above the valve plug 8'. As shown in FIG. 4, when the first solenoid valve 2 is opened for releasing the water, the water passes through the through apertures 602' to lift up the valve plug 8 in the valve chamber 601', such that the valve seat 604' is sealed and closed by the valve plug 8'. As shown in FIG. 5, when the first solenoid valve 2 is closed, the flush pipe 5 is at a negative pressure condition in such a manner that the valve plug 8 will drop down to move away from the valve seat 604' by gravity. In addition, the flush pipe 105 communicates with the ambient atmosphere through the air inlet aperture 603. As shown in FIG. 1, the water level of the flush pipe 105 is dropped to form the air isolated zone 106.

Figure 6:
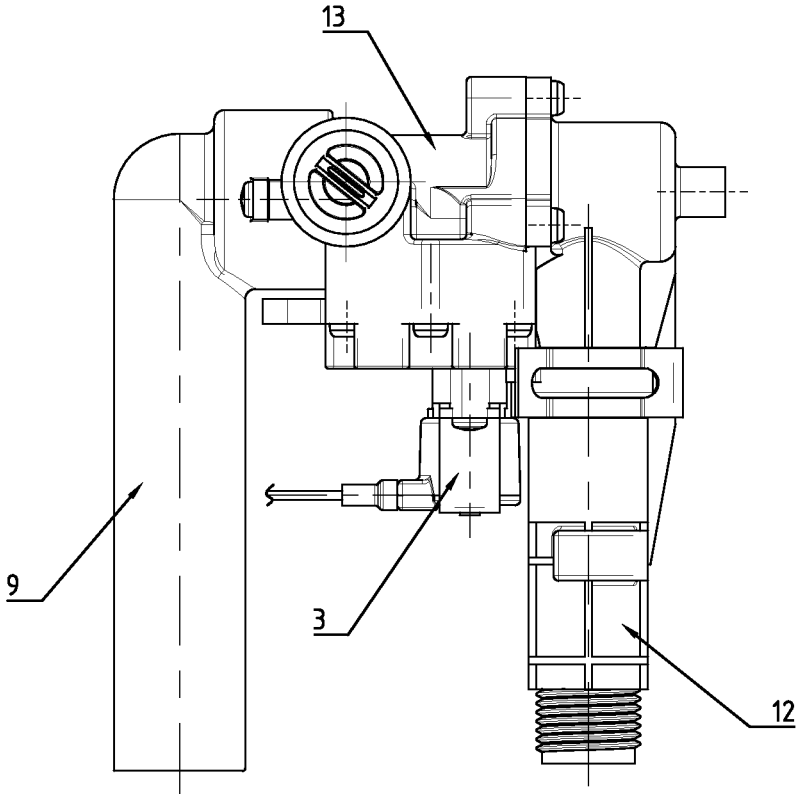
FIG. 6 is a side view of the solenoid valves to be installed in the water tank-less toilet flushing system according to the first preferred embodiment of the present invention.
Figure 7:
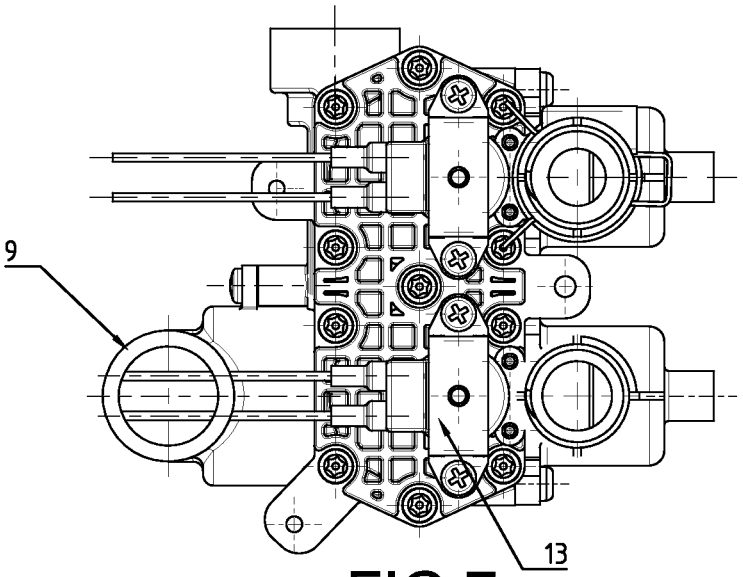
FIG. 7 is a top view of the solenoid valves to be installed in the water tank-less toilet flushing system according to the first preferred embodiment of the present invention.
Figure 8:
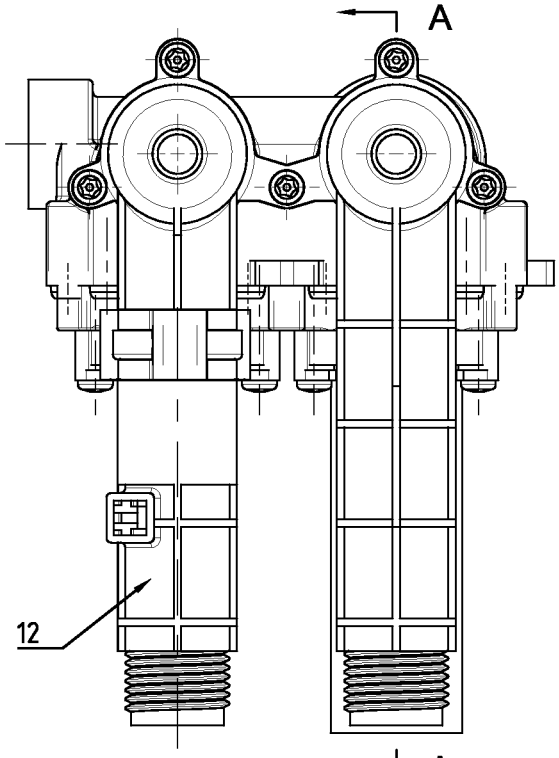
FIG. 8 is a front view of the solenoid valves to be installed in the water tank-less toilet flushing system according to the first preferred embodiment of the present invention.
Figure 13:
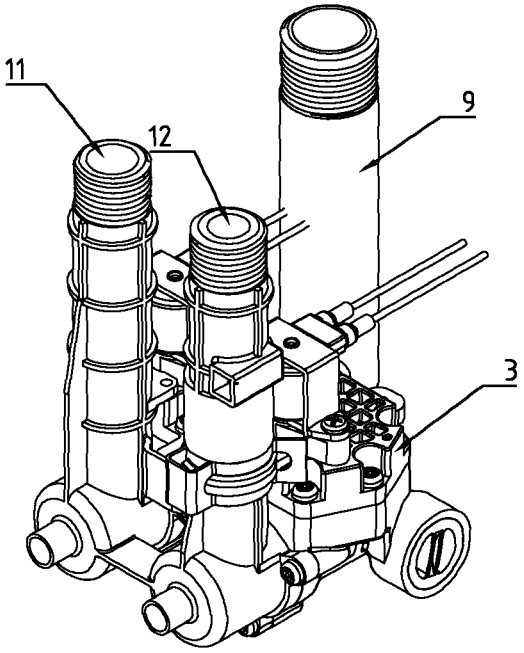
FIG. 13 is a bottom perspective view of the solenoid valve of the water tank-less toilet flushing system according to the first preferred embodiment of the present invention.

As shown in FIGS. 6 and 13, the toilet flushing system is constructed to have the first and second solenoid valves 2, 3, a water inlet pipe 9, two water outlet pipes 11, 12, and two pressure-controlled check valves. Accordingly, the first and second solenoid valves 2, 3 can be contained in a universal valve casing 13.

An inlet of the water inlet pipe 9 is connected to the water pipe 5, and an outlet of the water inlet pipe 9 is connected to the universal valve casing 13. In addition, the universal valve casing 13 comprises a transverse duct 1301 connecting between the outlet of the water inlet pipe 9 and the inlets of the first and second solenoid valves 2, 3 respectively. The first water outlet pipe 11 of the first solenoid valve 2 is connected with the injection pipe of the toilet bowl, and the second water outlet pipe 12 of the second solenoid valve 3 is connected to the flush pipe 105.

Since the working principle of the first and second solenoid valves 2, 3 are the same, the first solenoid valve 2 is described as an example to illustrate the configuration of the above preferred embodiment of the present invention. In addition, the first solenoid valve 2 comprises a valve water inlet 201, a solenoid valve seat 202, a valve core 203, an electromagnet 204 and a valve water outlet 205.

The first water outlet pipe 11 is a vertical pipe, wherein an upper end of the water outlet pipe 11 is fixed with the universal valve casing 13, wherein the pressure-controlled check valves 4 are provided at the upper portion of the water outlet pipe 11. The pressure-controlled check valve 4 comprises a control valve core 14 and a compression spring 15.

The first water outlet pipe 11 has an air intake hole 1102 located at an upper portion of the first outlet pipe 11, and an air intake valve seat 1101, wherein an inner slot 1103 is located within the air intake valve seat 1101 to communicate with the ambient atmosphere through the air intake hole 1102.

The valve water outlet 205 comprises an outlet water valve seat 206 provided at the universal valve casing 13, wherein the outlet water valve seat 206 is coaxial with the first water outlet pipe 11.

An axis of the air intake valve seat 1101 and an axis of the outlet water valve seat 206 are arranged horizontally. And, an axis of the first water outlet pipe 11 is intersected with, preferably perpendicular to, the axis of the air intake valve seat 1101 and the axis of the outlet water valve seat 206.

The control valve core 14 comprises a valve flap 1401, a hollow front valve stem 1402 frontwardly extended from the valve flap 1401, and a hollow rear valve stem 1403 rearwardly extended from the valve flap 1401 to coaxial with the front valve stem 1402, wherein the compression spring 15 is mounted within an inner hole of the rear valve stem 1403. In addition, one end (the left end) of the compression spring 15 is supported by a bottom face of the inner slot 1103 of the air intake valve seat 1101, and the other end (the right end) of the compression spring 15 is supported by the valve flap 1401 of the control valve core 14.

The front valve stem 1402 is loosely coupled at a valve inner hole 207 of the outlet water valve seat 206, and the rear valve stem 1403 is loosely coupled at the inner slot 1103 of the air intake valve seat 1101. The rear valve stem 1403 has a plurality of rear valve through holes 1405 communicating the interior of the rear valve stem 1403 with the exterior thereof, and the front valve stem 1402 has a plurality of front valve through holes 1404 communicating with the interior of the front valve stem 1402 with the exterior thereof.

A front sealing ring 17, which is made of rubber, is sleeved at a front ring groove formed a root portion of the front valve stem 1402 and a rear sealing ring 16, which is made of rubber, is sleeved at a rear ring groove formed at a root portion of the rear valve stem 1403. When the compression spring 15 is expanded to move the valve flap 1401, the front sealing ring 17 is sealed at the outlet water valve seat 206, and when the compression spring 15 is compressed to move the valve flap 1401, the rear sealing ring 16 is sealed at the air intake valve seat 1101.

Figure 9:
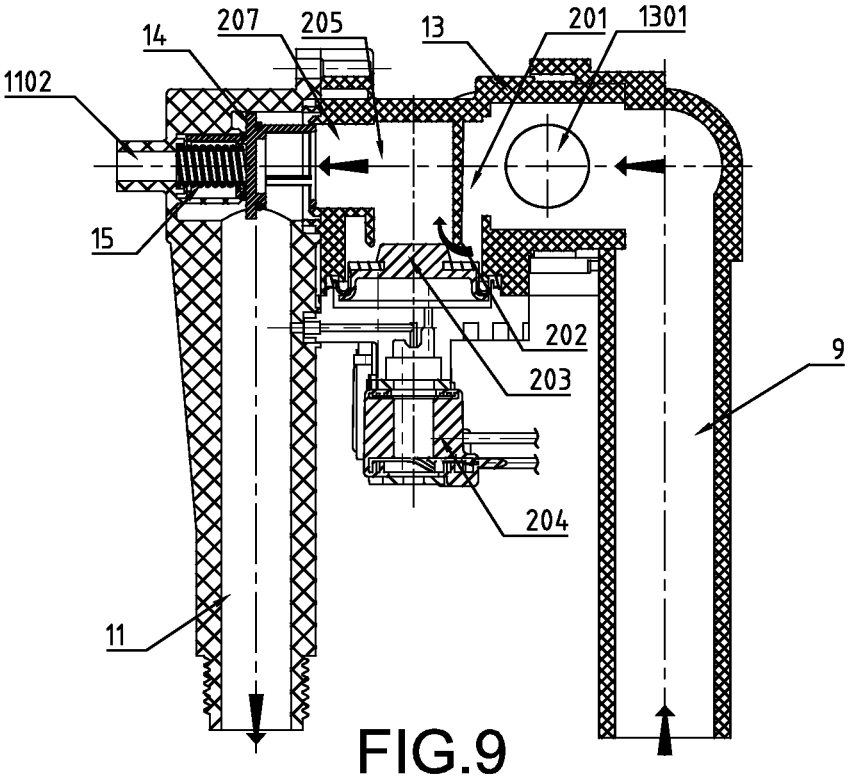
FIG. 9 is a sectional view of the solenoid valve of the water tank-less toilet flushing system according to the first preferred embodiment of the present invention, illustrating the solenoid valve at a closed condition.

As shown in FIG. 9, when the valve core 203 of the first solenoid valve 2 is opened and the water enters into the water inlet pipe 9, the compression spring 15 is pushed leftward by the control valve core 14 due to the water pressure generated by the water within the water inlet pipe 9. When the control valve core 14 moves leftward, the air intake valve seat 1101 is sealed by the rear rubber ring 16, so as to isolate the first water outlet pipe 11 from the ambient atmosphere. Therefore, the water generated from the water outlet 205 of the first solenoid valve 2 passes through the front valve through hole 1404 of the front valve stem 1402 to the first water outlet pipe 11, so as to start the flushing operation of the toilet flushing system of the present invention.

After the valve core 203 of the first solenoid valve 2 is closed, the water pressure at the water outlet 205 of the first solenoid valve is disappeared, such that no water pressure is provided on the right side of the valve flap 1401. Therefore, the compression spring 15 is pushed by the control valve core 14 to move rightward such that the rear sealing ring 16 is moved away from the air intake valve seat 1101 to open up the air intake valve seat 1101 and the outlet water valve seat 206 is sealed and closed by the front sealing ring 17. The air enters into the first water outlet pipe 11 through the intake hole 1102, the inner hole 1103 of the air intake valve seat 1101, and the rear valve through hole 1405 of the rear valve stem 1403, such that the negative pressure within the first water outlet pipe 11 disappears. As a result, the water level within the first water outlet pipe 11 drops down at the same level of the siphon pool 102 of the toilet bowl 1.

Figure 10:
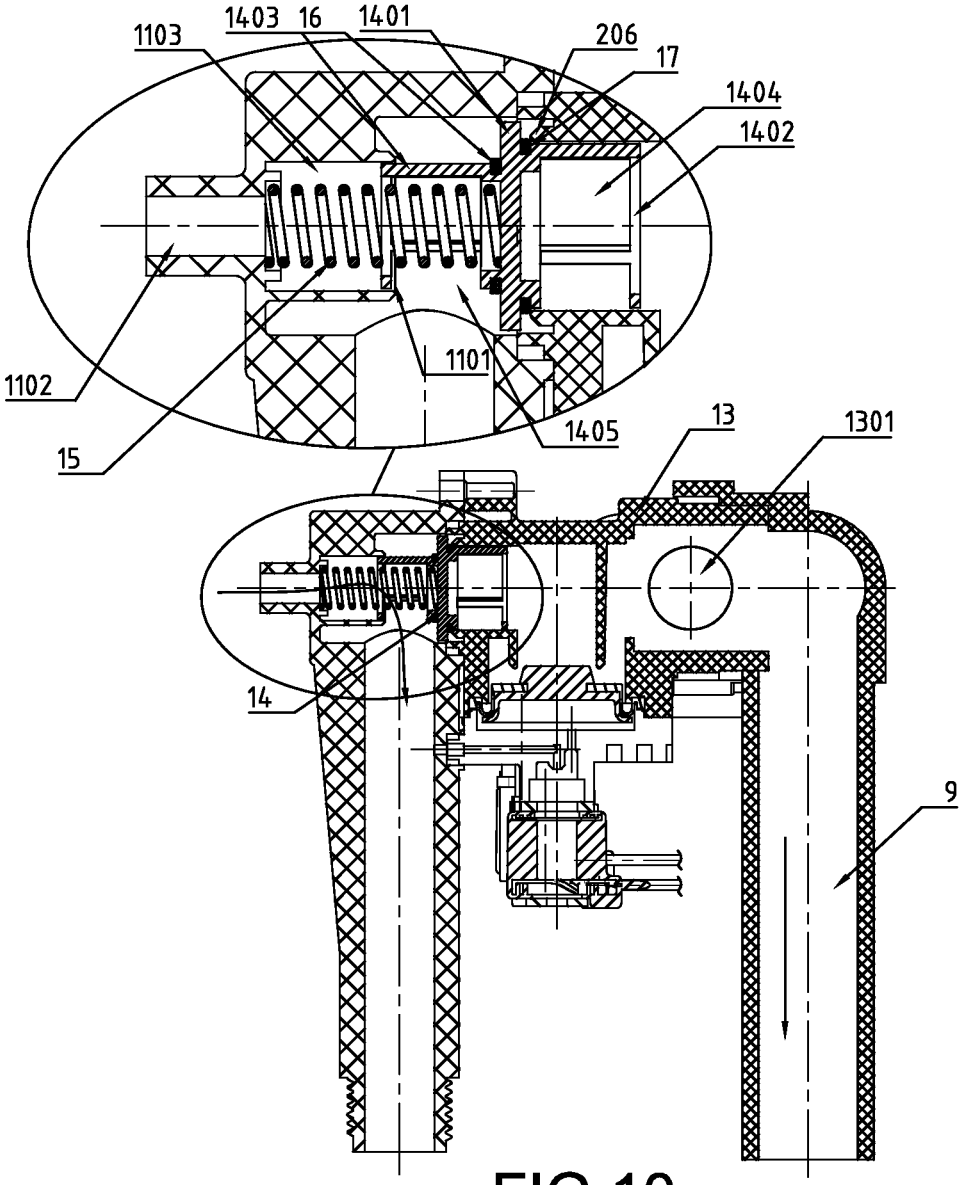
FIG. 10 is a sectional view of the solenoid valve of the water tank-less toilet flushing system according to the first preferred embodiment of the present invention, illustrating the solenoid valve at an opened condition.
Figure 11:
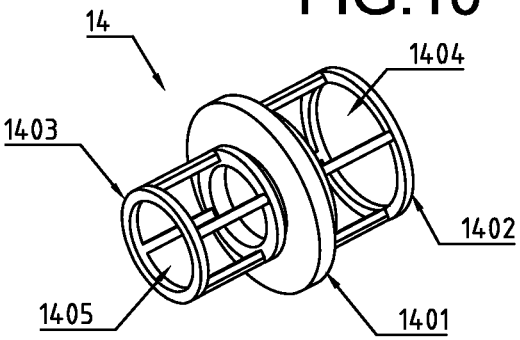
FIG. 11 is a perspective view of the control valve core of the pressure-controlled check valve according to the first preferred embodiment of the present invention.
Figure 12:
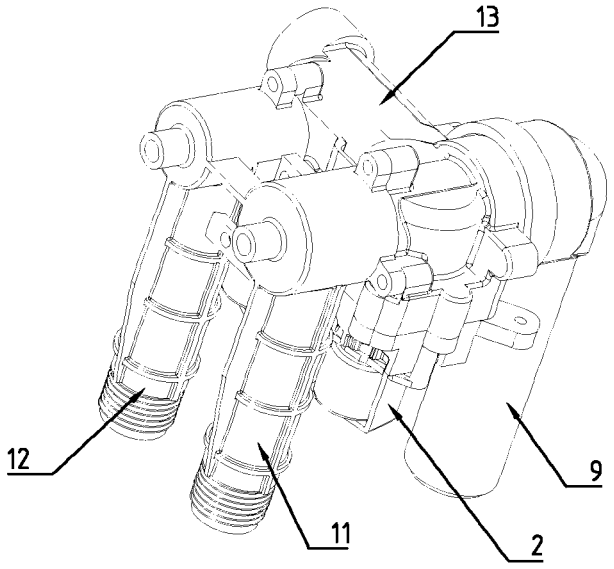
FIG. 12 is a perspective view of the solenoid valve of the water tank-less toilet flushing system according to the first preferred embodiment of the present invention.

As shown in FIG. 10, when the valve core 203 of the first solenoid valve 2 is opened as well as no water enters into the water inlet pipe 9, the outlet water valve seat 206 is sealed by the compressing spring 15 through the control valve core 14. The negative pressure within the water inlet pipe 9 will not be delivered to the first water outlet pipe 11. Moreover, the first water outlet pipe 11 communicates with the ambient atmosphere through the intake holes 1102, so that the sewage within the siphon pool 102 and the sewer gas within the flush port 101 won't flow back to the water inlet pipe 9 and water pipe 5 due to the siphon action, so as to prevent the water pollution therein.

Figure 14:
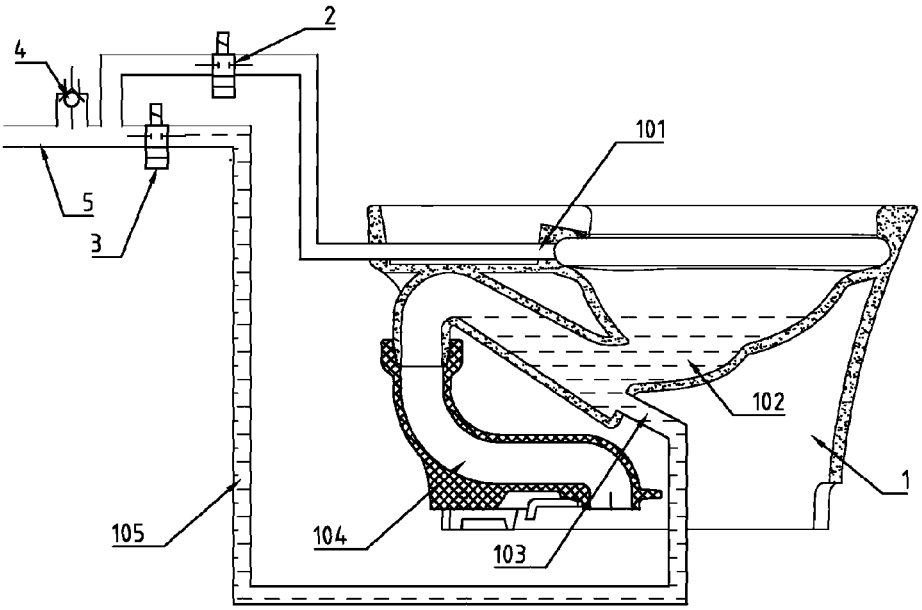
FIG. 14 illustrates an alternative mode of the water tank-less toilet flushing system according to the first preferred embodiment of the present invention.
Figure 15:
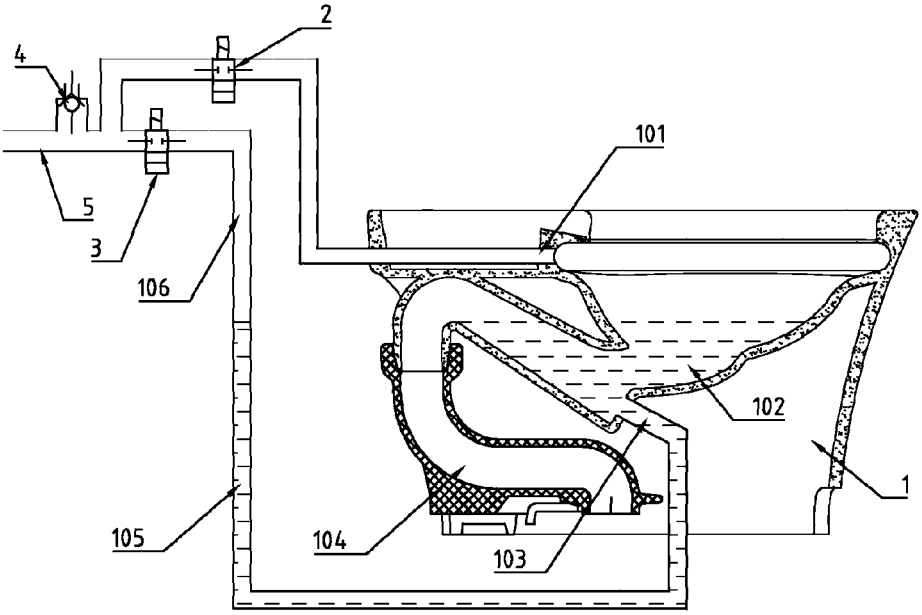
FIG. 15 illustrate the alternative mode of the water tank-less toilet flushing system according to the first preferred embodiment of the present invention, showing no water supplying through the water pipe and the solenoid valve at an opened condition.

FIGS. 14 and 15 illustrate an alternative mode of the water tank-less toilet flushing system which comprises a flushing system and a control system. The control system comprises a controller, a first solenoid valve 2, a second solenoid valve 3, and a pressure-controlled check valve 4. The flushing system comprises a toilet bowl 1 having a flush port 101 for introducing water to flush the toilet pool 1, a siphon pool 102 at a bottom portion of the toilet bowl 1 to maintain a predetermined water level therein as a barrier to sewer gas entering and as a receptacle for waste, an injection port 103 located at the bottom portion of the toilet bowl 1 toward a sewage discharging direction of the siphon pool 102, a drain port 104 located at a rear portion of the siphon pool 102 to communicate with the siphon pool 102. In addition, an outlet of the first solenoid valve 2 is operatively linked to the flush port 101 and the outlet of the second solenoid valve 3 is operatively linked to the injection port 103.

The first solenoid valve 2 and the second solenoid valve 3 are located higher than the top surface of the toilet bowl 1. Therefore, in case of the toilet bowl 1 being clogged, the higher water level in the toilet bowl 1 during flushing operation will not cause the sewage in the toilet bowl 1 to be backflow to and pollute the first solenoid valve 2 and the second solenoid valve 3. Accordingly, a signal input terminal of each of the first solenoid valve 2 and the second solenoid valve 3 is operatively linked to a controller of the control system. The inlets of the first solenoid valve 2 and the second solenoid vale 3 are connected to a water pipe 5 via the pressure-controlled check valve 4.

Accordingly, the pressure-controlled check valve 4 can be a positive pressure-controlled check valve, negative pressure-controlled check valve, or zero pressure-controlled check valve. In particular, the pressure-controlled check valve 4 can be a float-controlled valve, gravity-controlled valve, or a spring-loaded valve.

When supplying the water through the water pipe 5, the pressure-controlled check valve 4 will be closed by the water pressure. When stops supplying the water provided to the water pipe 5, a negative pressure generates from the water pipe 5 to open the pressure-controlled check valve 4 so as to communicate the water pipe 5 with the ambient atmosphere. In other words, the negative pressure is offset due to opened condition of the pressure controlled check valve 4. As shown in FIG. 15, if the first and second solenoid valves 2, 3 are opened, the water level of the flush pipe 105 communicating with the injection port 103 returns at the lower level to generate an air isolated zone 106 since the first and second solenoid valves 2, 3 are located higher than the top surface of the toilet bowl 1.

It is worth mentioning that the pressure-controlled check valve 4 is installed between the water pipe 5 and the solenoid valve to control the pressure within the water pipe 5. In other words, the minimum pressure within the water pipe 5 is the atmosphere. No matter there is a water flow within the water pipe 5 or not, the pressure within the water pipe 5 must be higher or equal to the pressure at the outlet of each of the first and second solenoid valves 2, 3.

Because the positions of the first and second solenoid valves 2, 3 are higher than the top surface of the toilet bowl 1, no matter there is a water flow within the water pipe 5 or the first and second solenoid valve 2, 3 at the opened condition, the sewage within the siphon pool 102 and the sewer gas within the toilet bowl 1 will not backflow to the water pipe 5 so as to prevent the water pollution within the water pipe 5.

Figure 16:
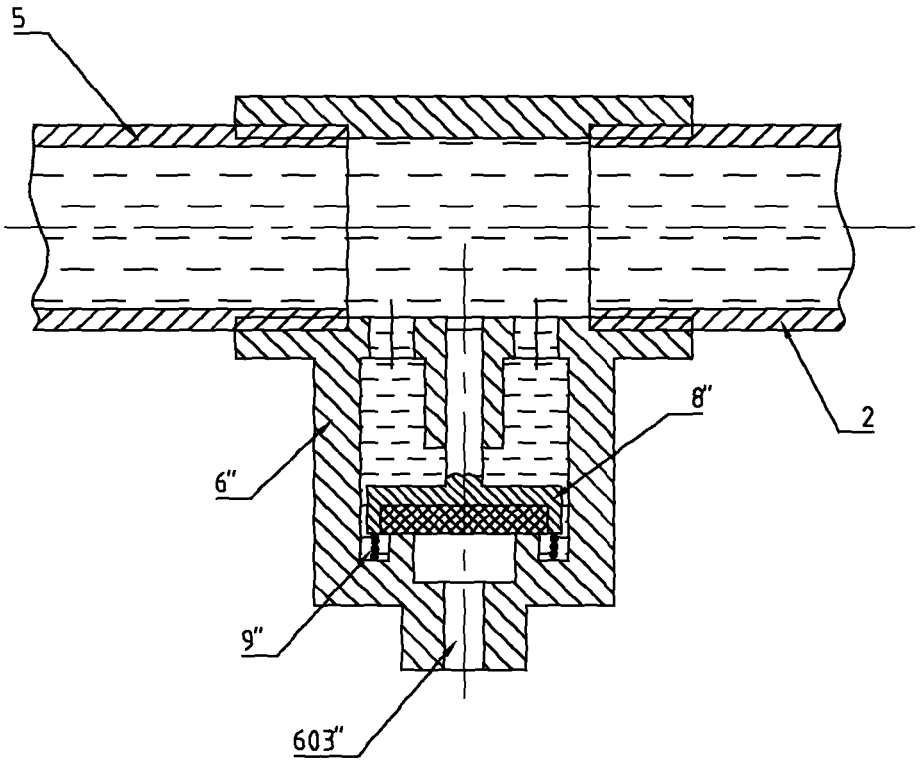
FIG. 16 is a sectional view of a pressure-controlled check valve of the water tank-less toilet flushing system according to the first preferred embodiment of the present invention, illustrating the pressure-controlled check valve as a spring-loaded check valve at a closed condition.
Figure 17:
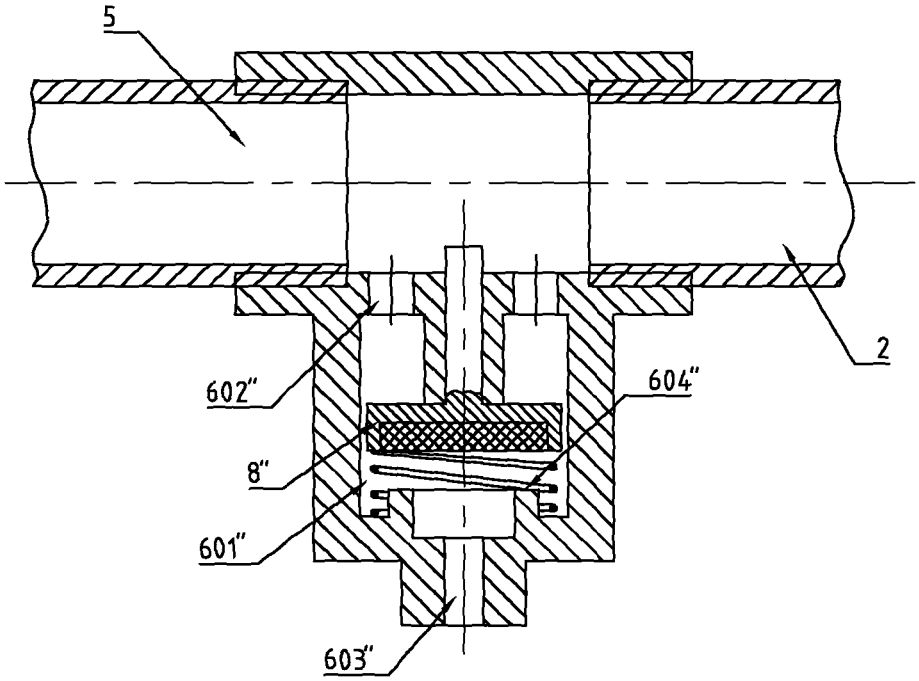
FIG. 17 is a sectional view of a pressure-controlled check valve of the water tank-less toilet flushing system according to the first preferred embodiment of the present invention, illustrating the pressure-controlled check valve as a spring-loaded check valve at an opened condition.

As shown in FIGS. 16 and 17, the pressure-controlled check valve 4 is embodied as a spring-loaded check valve which comprises an outer case 6", a compression spring 9" and a valve plug 8", wherein the compression spring 9" is able to lift up the valve plug 8" by means of spring force.

Moreover, an inlet of the outer case 6" is connected to the water pipe 5, and the outlet of the outer case 6" is connected to the first solenoid valve 2. The outer case 6" comprises a valve chamber 601", a plurality of through holes 602", an air inlet hole 603", and a spring valve seat 604" located at a bottom end of the air inlet hole 603", wherein the air inlet hole 603" communicates with the valve chamber 601". The valve chamber 601" is linked to the water pipe 5 through the through holes 602". The spring valve seat 604" is located above the air inlet hole 603".

The valve plug 8" is disposed within the valve chamber 601", and the spring valve seat 604" is located on a top of the valve plug 8". As shown in FIG. 16, when there is a water pressure within the water pipe 5, the compression spring 9" is pushed by the valve plug 8" by means of water pressure so as to compress the compression spring 9", such that the spring valve seat 604" is closed by the valve plug 8" to seal the air inlet hole 603". As shown in FIG. 17, when there is no water in the water pipe 5 to generate a negative pressure, the valve plug 8" is lifted by the compression spring 9", such that the valve plug 8" will move away from the spring valve seat 604". Therefore, the water pipe 5 communicates with the ambient atmosphere through the air inlet hole 603".

Figure 18:
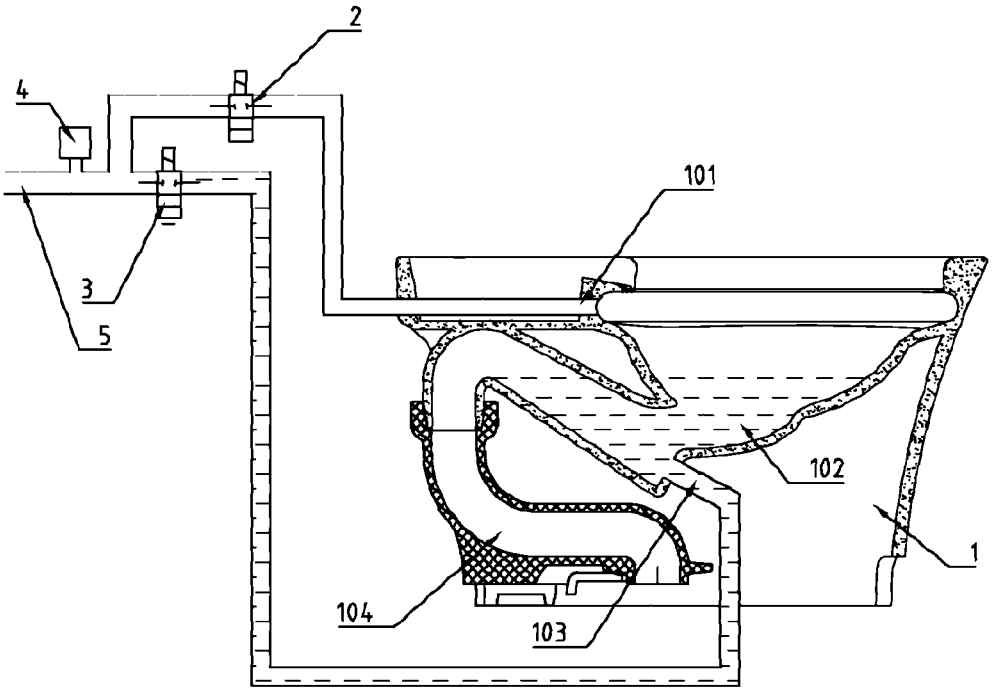
FIG. 18 is a schematic view of a water tank-less toilet flushing system according to a second preferred embodiment of the present invention.
Figure 19:
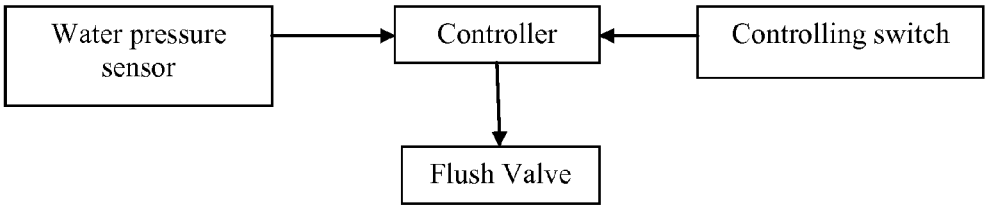
FIG. 19 is a block diagram illustrating the control system of the water tank-less toilet flushing system according to the second preferred embodiment of the present invention.

As shown in FIGS. 18 and 19, a water tank-less toilet flushing system according to a second embodiment illustrates an alternative mode of the first embodiment, wherein the water tank-less toilet flushing system comprises a flushing system and a control system. The control system comprises a power source, a controller, a controlling switch, a water pressure sensor, a first solenoid valve 2 and a second solenoid valve 3. The flushing system comprises a toilet bowl 1 having a flush port 101 for introducing water to flush the toilet pool 1, a siphon pool 102 at a bottom portion of the toilet bowl 1 to maintain a predetermined water level therein as a barrier to sewer gas entering and as a receptacle for waste, an injection port 103 located at the bottom portion of the toilet bowl 1 toward a sewage discharging direction of the siphon pool 102, a drain port 104 located at a rear portion of the siphon pool 102 to communicate with the siphon pool 102. In addition, an outlet of the first solenoid valve 2 is operatively linked to the flush port 101 and the outlet of the second solenoid valve 3 is operatively linked to the injection port 103.

The first solenoid valve 2 and the second solenoid valve 3 are located higher than the top surface of the toilet bowl 1. Therefore, in case of the toilet bowl 1 being clogged, the higher water level in the toilet bowl 1 during flushing operation will not cause the sewage in the toilet bowl 1 to be backflow to and pollute the first solenoid valve 2 and the second solenoid valve 3. Accordingly, a signal input terminal of each of the first solenoid valve 2 and the second solenoid valve 3 is operatively linked to a controller of the control system. Inlets of the first solenoid valve 2 and the second solenoid vale 3 are connected to the water pipe 5 via a check valve 4.

The check valve is the water pressure sensor 4 that a pressure input of the water pressure sensor 4 is linked to the water pipe 5 to detect the water pressure therein. A pressure signal output terminal of the water pressure sensor 4 is operatively linked to a water pressure signal input terminal of the controller. When there is a water pressure in the water pipe 5, the water pressure sensor 4 will sent a high electric level to the water pressure signal input terminal of the controller. In this condition, the controlling switch is arranged to control the operation of each of the first solenoid valve 2 and the second solenoid valve 3 via the controller for starting the flushing operation of the flushing system. When there is no water in the water pipe 5 to create a negative pressure therewithin, the water pressure sensor 4 will sent a low electric level to the water pressure signal input terminal of the controller. In this condition, the controlling switch cannot control the operation of each of the first solenoid valve 2 and the second solenoid valve 3 in the opened condition via the controller. As a result, the sewage within the siphon pool 102 and the sewer gas within the toilet bowl 1 cannot backflow to the water pipe 5 due to the siphon action, so as to prevent water pollution within the water pipe 5. Once supplying the water to the water pipe 5 again, the main contact of the water pressure sensor 4 is closed, such that the control system resumes back to its normal working condition.

Figure 22:
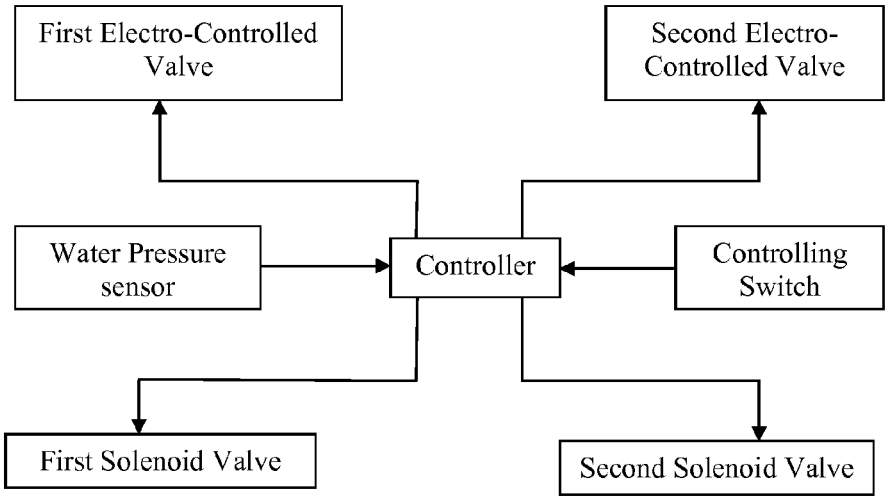
FIG. 22 is a block diagram illustrating the first alternative mode of the control system of the water tank-less toilet flushing system according to the second preferred embodiment of the present invention.
Figure 20:
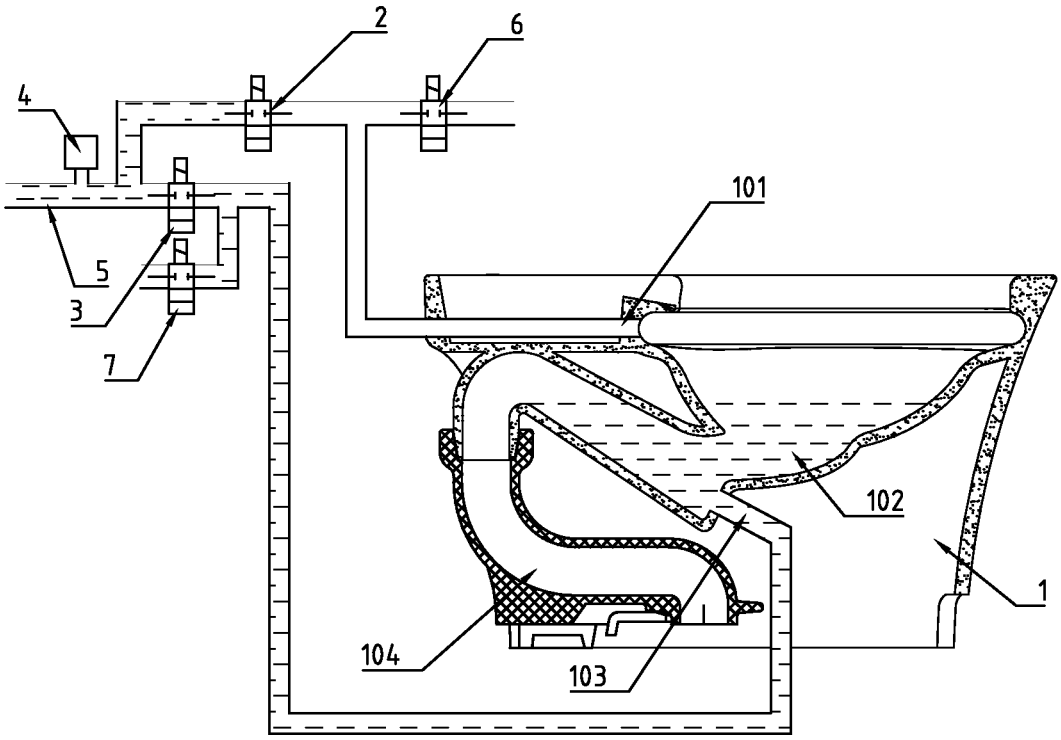
FIG. 20 illustrates a first alternative mode of the control system of the water tank-less toilet flushing system according to the second preferred embodiment of the present invention, showing the water pressure in the water pipe.
Figure 21:
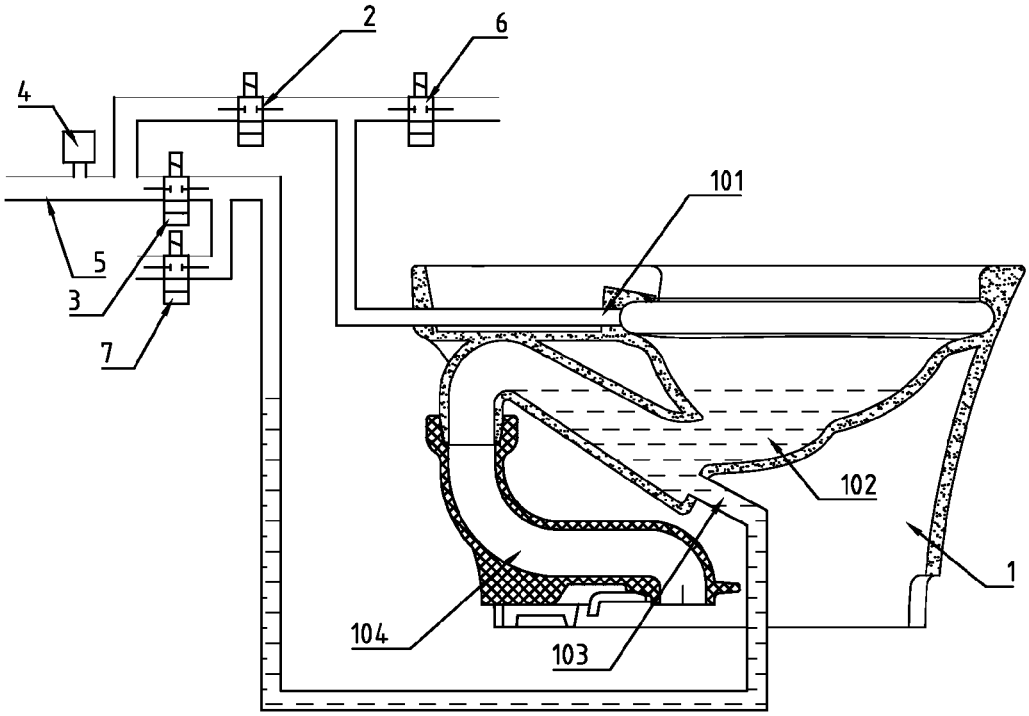
FIG. 21 illustrates the first alternative mode of the control system of the water tank-less toilet flushing system according to the second preferred embodiment of the present invention, showing no pressure in the water pipe.

Referring to FIGS. 20 to 22 of the drawings, a first alternative mode of the control system according to the second preferred embodiment of the present invention is illustrated, wherein the structural configuration of the control system has the same above mentioned components and the check valve comprises a first electro-controlled valve 6 and a second electro-controlled valve 7. Inlets of the first and second electro-controlled valves 6, 7 are communicated with the ambient atmosphere. An outlet of the first electro-controlled valve 6 is linked to the outlet of the first solenoid valve 2. An outlet of the second electro-controlled valve 7 is linked to the outlet of the second solenoid valve 3. The outlet of the first solenoid valve 2 is linked to the flush port 101 of the toilet bowl 1. The outlet of the second solenoid valve 3 is linked to the injection port 103 of the toilet bowl 1.

When supplying water to the water pipe 5, the water pressure sensor 4 will sent a high electric level to the water pressure signal input terminal of the controller. In this condition, the controller will move the first electro-controlled valve 6 and the second electro-controlled valve 7 in the closed condition. The controlling switch is actuated to move the first solenoid valve 2 and the second solenoid valve 3 in the opened condition via the controller for starting the flushing operation of the flushing system.

When there is no water in the water pipe 5 to create a negative pressure therewithin, the water pressure sensor 4 will sent a low electric level to the water pressure signal input terminal of the controller. In this condition, the controller will move the first electro-controlled valve 6 and the second electro-controlled valve 7 in the opened condition. The outlets of the first solenoid valve 2 and the second solenoid valve 3 will communicate with the ambient atmosphere through the first electro-controlled valve 6 and the second electro-controlled valve 7. At this time when the controlling switch is actuated to move the first solenoid valve 2 and the second solenoid valve 3 in the opened condition, the negative pressure at the water pipe 5 will not transferred to the first solenoid valve 2 and the second solenoid valve 3 because of the opened condition of the first solenoid valve 2 and the second solenoid valve 3. As a result, the negative pressure at the water pipe 5 will not create any siphon action that the sewage within the siphon pool 102 and the sewer gas within the toilet bowl 1 will backflow to the water pipe 5, so as to prevent water pollution within the water pipe 5. Once supplying the water to the water pipe 5 again, the water pressure sensor 4 will sent a high electric level to the water pressure signal input terminal of the controller, such that the controller will move the first electro-controlled valve 6 and the second electro-controlled valve 7 in the closed condition, so as to resume the control system back to its normal working condition.

Figure 23:
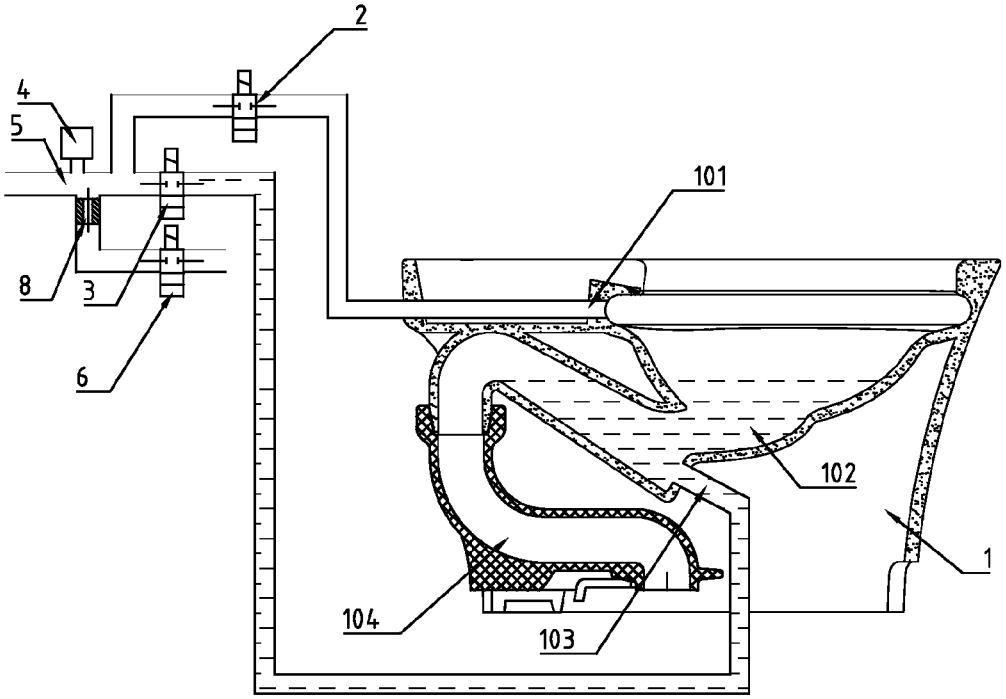
FIG. 23 illustrates a second alternative mode of the control system of the water tank-less toilet flushing system according to the second preferred embodiment of the present invention.
Figure 24:
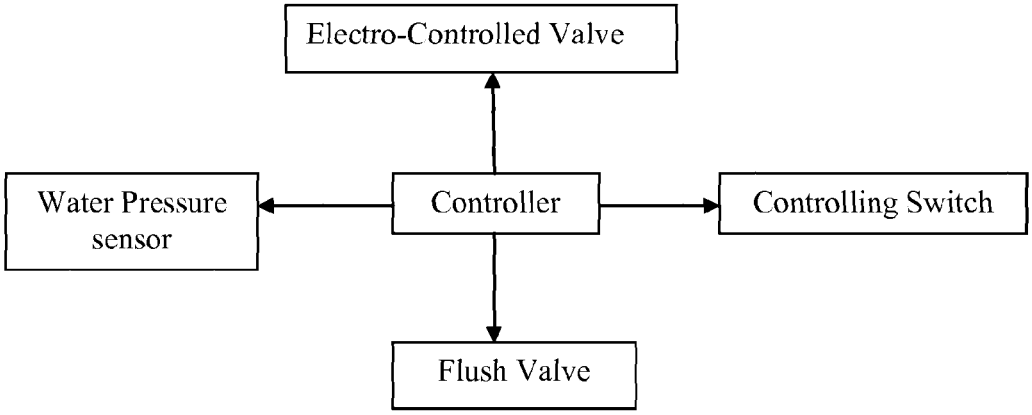
FIG. 24 is a block diagram illustrating the second alternative mode of the control system of the water tank-less toilet flushing system according to the second preferred embodiment of the present invention.

As shown in FIGS. 23 and 24, a second alternative mode of the control system according to the second preferred embodiment of the present invention is illustrated, wherein the structural configuration of the control system has the same above mentioned components and further comprises a first electro-controlled valve 6 only. In other words, the second electro-controlled valve 7 is omitted in the second alternative mode. Accordingly, the inlet of the first electro-controlled valve 6 communicates with the ambient atmosphere while the outlet of the first electro-controlled valve 6 links to the throttle orifice 8 which communicates with the water pipe 5.

When there is water pressure within the water pipe 5, the water pressure sensor 4 will sent a high electric level to the water pressure signal input terminal of the controller. In this condition, the controller will move the first electro-controlled valve 6 in the closed condition. The controlling switch is actuated to move the first solenoid valve 2 and the second solenoid valve 3 in the opened condition via the controller for starting the flushing operation of the flushing system.

When there is no water in the water pipe 5 to create a negative pressure therewithin, the water pressure sensor 4 will sent a low electric level to the water pressure signal input terminal of the controller. In this condition, the controller will move the first electro-controlled valve 6 in the opened condition. The water pipe 5 will communicate with the ambient atmosphere through the throttle orifice 8 and the electro-controlled valve 6 will also communicate with the ambient atmosphere as well. The pressure within the water pipe 5 will return back to the ambient pressure. At this time when the controlling switch is actuated to move the first solenoid valve 2 and the second solenoid valve 3 in the opened condition, the negative pressure at the water pipe 5 will be dismissed and is not transferred to the first solenoid valve 2 and the second solenoid valve 3 because of the normal pressure in the water pipe 5. As a result, the negative pressure at the water pipe 5 will not create any siphon action that the sewage within the siphon pool 102 and the sewer gas within the toilet bowl 1 will backflow to the water pipe 5, so as to prevent water pollution within the water pipe 5. Once supplying the water to the water pipe 5 again, the pressure within the water pipe 5 will be rapidly increased through the throttle orifice 8, such that the water pressure sensor 4 will sent a high electric level to the water pressure signal input terminal of the controller. Then, the controller will move the first electro-controlled valve 6 in the closed condition, so as to resume the control system back to its normal working condition.

It is worth mentioning that the first electro-controlled valve 6 can be a solenoid valve or a motor-driven valve, such as rotary valve and displacement control valve.

Figure 25:
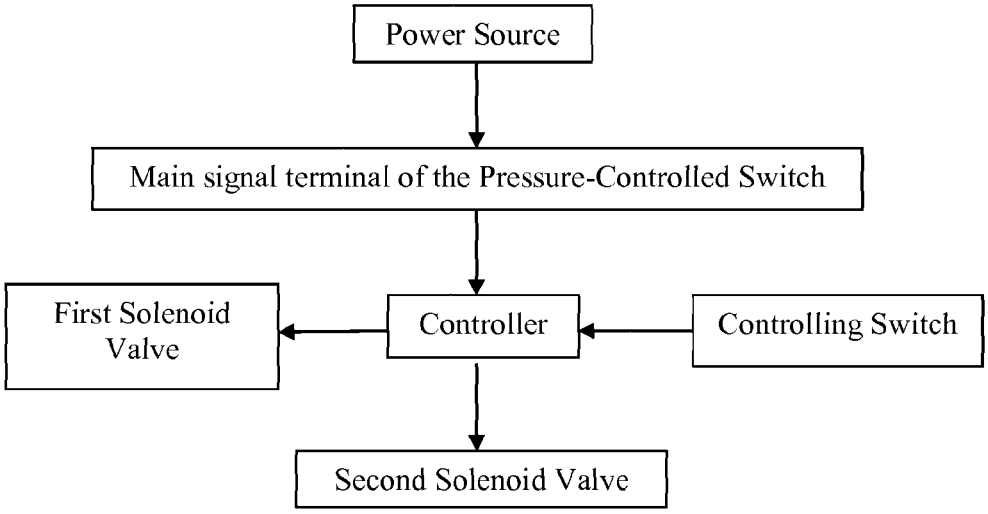
FIG. 25 illustrates a third alternative mode of the control system of the water tank-less toilet flushing system according to the second preferred embodiment of the present invention.

FIG. 25 illustrates another alternative mode of the control system. The control system comprises a power source, a controller, a controlling switch, a pressure-controlled switch, a first solenoid valve 2, and a second solenoid valve 3. The flushing system comprises a toilet bowl 1 having a flush port 101 for introducing water to flush the toilet pool 1, a siphon pool 102 at a bottom portion of the toilet bowl 1 to maintain a predetermined water level therein as a barrier to sewer gas entering and as a receptacle for waste, an injection port 103 located at the bottom portion of the toilet bowl 1 toward a sewage discharging direction of the siphon pool 102, a drain port 104 located at a rear portion of the siphon pool 102 to communicate with the siphon pool 102. In addition, an outlet of the first solenoid valve 2 is operatively linked to the flush port 101 and the outlet of the second solenoid valve 3 is operatively linked to the injection port 103.

The first solenoid valve 2 and the second solenoid valve 3 are located higher than the top surface of the toilet bowl 1. Therefore, in case of the toilet bowl 1 being clogged, the higher water level in the toilet bowl 1 during flushing operation will not cause the sewage in the toilet bowl 1 to be backflow to and pollute the first solenoid valve 2 and the second solenoid valve 3. Accordingly, a signal input terminal of each of the first solenoid valve 2 and the second solenoid valve 3 is operatively linked to a controller of the control system. Inlets of the first solenoid valve 2 and the second solenoid vale 3 are connected to the water pipe 5 via a check valve 4.

The check valve is the pressure-controlled switch 4 that a pressure input of the pressure-controlled switch 4 is linked to the water pipe 5 to detect the water pressure therein. A main signal terminal of the pressure-controlled switch 4 is electrically linked to a 5V electric supplying circuit in series connection, wherein the 5V electric supplying circuit is electrically linked between the power source and the controller. When there is a water pressure in the water pipe 5, the main signal terminal of the pressure-controlled switch 4 is closed. In this condition, the controlling switch is arranged to control the operation of each of the first solenoid valve 2 and the second solenoid valve 3 in the opened condition via the controller for starting the flushing operation of the flushing system. When there is no water in the water pipe 5 to create a negative pressure therewithin, the main signal terminal of the pressure-controlled switch 4 is opened to cut off the electrical power of the controller. In this condition, the controlling switch cannot control the operation of each of the first solenoid valve 2 and the second solenoid valve 3 in the opened condition via the controller. As a result, the sewage within the siphon pool 102 and the sewer gas within the toilet bowl 1 cannot backflow to the water pipe 5 due to the siphon action, so as to prevent water pollution within the water pipe 5. Once supplying the water to the water pipe 5 again, the main signal terminal of the water pressure sensor 4 is closed again, such that the control system resumes back to its normal working condition.

Figure 26:
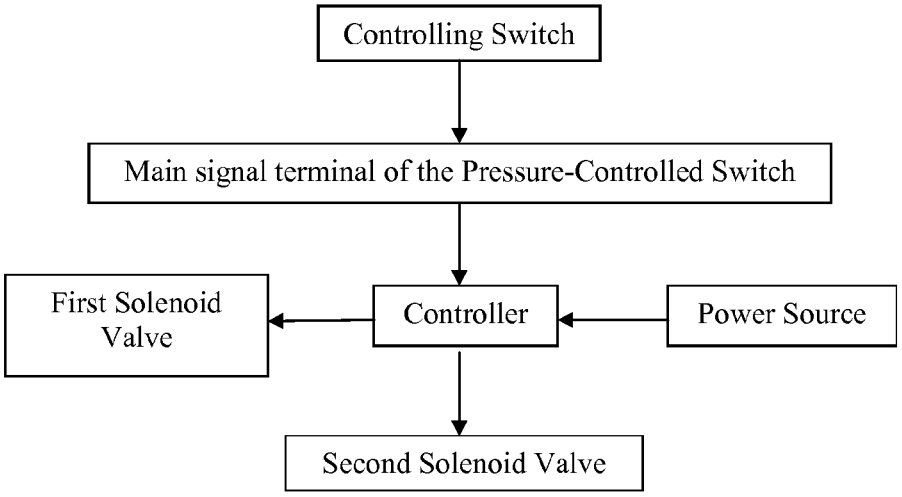
FIG. 26 illustrates a fourth alternative mode of the control system of the water tank-less toilet flushing system according to the second preferred embodiment of the present invention.

Alternatively, the main signal terminal of the pressure-controlled switch 4 is electrically linked to a control circuit in series connection, as shown in FIG. 26, wherein the control circuit is electrically linked between the controlling switch and the controller. When there is a water pressure in the water pipe 5, the main signal terminal of the pressure-controlled switch 4 is closed. In this condition, the controlling switch is arranged to control the operation of each of the first solenoid valve 2 and the second solenoid valve 3 via the controller for starting the flushing operation of the flushing system. When there is no water in the water pipe 5 to create a negative pressure therewithin, the main signal terminal of the pressure-controlled switch 4 is opened, so as to cut off the electrical connection between the controlling switch and the controller. So, the controller cannot send out any control signal to the controlling switch. In this condition, the controlling switch cannot control the operation of each of the first solenoid valve 2 and the second solenoid valve 3 in the opened condition via the controller. As a result, the sewage within the siphon pool 102 and the sewer gas within the toilet bowl 1 cannot backflow to the water pipe 5 due to the siphon action, so as to prevent water pollution within the water pipe 5. Once supplying the water to the water pipe 5 again, the main signal terminal of the water pressure sensor 4 is closed again, such that the control system resumes back to its normal working condition.

Figure 27:
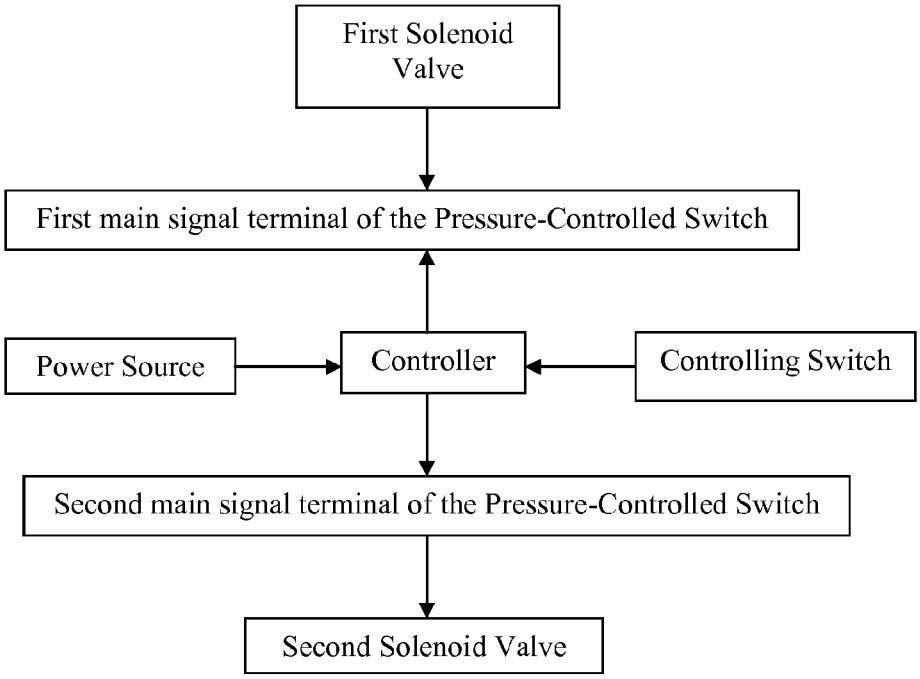
FIG. 27 illustrates a fifth alternative mode of the control system of the water tank-less toilet flushing system according to the second preferred embodiment of the present invention.

Alternatively, the pressure-controlled switch 4 has a first main signal terminal and a second main signal terminal, as shown in FIG. 27. The first main signal terminal of the pressure-controlled switch 4 is electrically linked to a first control circuit in series connection, wherein the first control circuit is electrically linked between the first solenoid valve 2 and the controller. The second main signal terminal of the pressure-controlled switch 4 is electrically linked to a second control circuit in series connection, wherein the second control circuit is electrically linked between the second solenoid valve 3 and the controller. When there is a water pressure in the water pipe 5, the first and second main signal terminal of the pressure-controlled switch 4 are closed. In this condition, the controlling switch is arranged to control the operation of each of the first solenoid valve 2 and the second solenoid valve 3 via the controller for starting the flushing operation of the flushing system. When there is no water in the water pipe 5 to create a negative pressure therewithin, the first and second main signal terminals of the pressure-controlled switch 4 are opened, so as to cut off the electrical connection between the first solenoid valve 2 and the controller, and the electrical connection between the second solenoid valve 3 and the controller. So, the controller cannot send out any control signal to the first and second solenoid valves 2, 3. In this condition, the first and second solenoid valves 2, 3 cannot be moved to their opened conditions via the controller. As a result, the sewage within the siphon pool 102 and the sewer gas within the toilet bowl 1 cannot backflow to the water pipe 5 due to the siphon action, so as to prevent water pollution within the water pipe 5. Once supplying the water to the water pipe 5 again, the first and second main signal terminals of the water pressure sensor 4 are closed again, such that the control system resumes back to its normal working condition.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A water tank-less toilet flushing system, comprising:

a flushing system which comprises a toilet bowl having a flush port, a siphon pool at a bottom portion of said toilet bowl, an injection port located at said bottom portion of said toilet bowl toward a sewage discharging direction of said siphon pool, and a drain port located at a rear portion of said siphon pool; and a control system which comprises:

a flush valve located higher than a top surface of said toilet bowl, wherein an inlet of said flush valve is arranged for connecting to a water pipe to guide water to flow toward said toilet bowl; and a check valve operatively linked to said flush valve, wherein when said flush valve is opened, said check valve is closed due to a water pressure for enabling the water to flush said flushing system, wherein when said flush valve is closed, said check valve is opened for communicating an interior of said flush valve with an ambient atmosphere to prevent water in said toilet bowl to be backflow to said flush valve.

2. The water tank-less toilet flushing system, as recited in claim 1, wherein said flush valve comprises a first solenoid valve having an outlet operatively linked to said flush port, and a second solenoid valve having an outlet operatively linked to said injection port.

3. The water tank-less toilet flushing system, as recited in claim 2, wherein said flushing system further comprises a flush pipe extended from said solenoid valve 2 to said injection port of said toilet bowl to define an air isolated zone at said flush pipe and below said first solenoid valve.

4. The water tank-less toilet flushing system, as recited in claim 1, wherein said check valve is a float-controlled check valve which comprises an outer casing and a floater, wherein said outer casing has an inlet operatively linked to an outlet of said flush valve and an outlet operatively linked to said injection port, wherein said outer casing further one or more through apertures, a floating chamber communicating with said outlet of said flush valve through said through apertures, and an air inlet aperture communicating with said floating chamber, wherein said floater is disposed in said floating chamber, wherein when said flush valve is opened for enabling the water entering into said floating chamber through said through apertures, said floater is lifted upwardly to seal and close said air inlet aperture, so as to close said float-controlled check valve, wherein when said flush valve is closed, said floater is dropped downwardly to open up said air inlet aperture, so as to open said float-controlled check valve.

5. The water tank-less toilet flushing system, as recited in claim 1, wherein said check valve is a gravity-controlled check valve which comprises an outer casing and a valve plug, wherein said outer casing has an inlet operatively linked to an outlet of said flush valve and an outlet operatively linked to said injection port, wherein said outer casing further one or more through apertures, a valve chamber communicating with said outlet of said flush valve through said through apertures, and an air inlet aperture communicating with said valve chamber, wherein said valve plug is disposed in said valve chamber, wherein when said flush valve is opened for enabling the water entering into said valve chamber through said through apertures, said valve plug is lifted upwardly to seal and close said air inlet aperture, so as to close said gravity-controlled check valve, wherein when said flush valve is closed, said valve plug is dropped downwardly by gravity to open up said air inlet aperture, so as to open said gravity-controlled check valve.

6. The water tank-less toilet flushing system, as recited in claim 1, wherein said check valve is a spring-loaded check valve which comprises an outer case, a compression spring, and a valve plug, wherein said outer casing has an outlet operatively linked to said flush valve, wherein said outer casing further one or more through apertures, a valve chamber communicating with said flush valve through said through apertures, and an air inlet aperture communicating with said valve chamber, wherein said valve plug is disposed in said valve chamber and is urged by said compression spring, wherein when said flush valve is opened for enabling the water entering into said valve chamber through said through apertures, said valve plug is pushed by the water pressure in said valve chamber to seal and close said air inlet aperture, so as to close said spring-loaded check valve, wherein when said flush valve is closed, said valve plug is pushed by said compression spring to open up said air inlet aperture, so as to open said spring-loaded check valve.

7. The water tank-less toilet flushing system, as recited in claim 2, wherein said flushing system further comprises a water inlet pipe, first and second water outlet pipes, and a universal valve casing where said first and second solenoid valves are contained in said universal valve casing, wherein two of said check valves are operatively linked to said first and second solenoid valves respectively, wherein said first water inlet pipe is connected between said first solenoid valve and said injection port, and said second inlet pipe is connected between said second solenoid valve and said flush port.

8. The water tank-less toilet flushing system, as recited in claim 7, wherein said water inlet pipe has an inlet arranged for connecting to said water pipe and an outlet connected to said universal valve casing, wherein said universal valve casing comprises a transverse duct connecting between said outlet of said water inlet pipe and inlets of said first and second solenoid valves respectively, wherein said first water outlet pipe has an air intake hole located at an upper portion of said first outlet pipe, and an air intake valve seat, wherein an inner slot is located within said air intake valve seat to communicate with the ambient atmosphere through said air intake hole.

9. The water tank-less toilet flushing system, as recited in claim 8, wherein said first solenoid valve, which is identical to said second solenoid, comprises a valve water inlet, a solenoid valve seat, a valve core, an electromagnet, and a valve water outlet, wherein said valve water outlet comprises an outlet water valve seat provided at said universal valve casing, wherein said outlet water valve seat is coaxial with said first water outlet pipe.

10. The water tank-less toilet flushing system, as recited in claim 9, wherein an axis of said air intake valve seat and an axis of said outlet water valve seat are arranged horizontally, wherein an axis of said first water outlet pipe is intersected with the axis of said air intake valve seat and the axis of said outlet water valve seat 206.

11. The water tank-less toilet flushing system, as recited in claim 10, wherein said check valve comprises a control valve core and a compression spring, wherein said control valve core comprises a valve flap, a hollow front valve stem frontwardly extended from said valve flap, and a hollow rear valve stem rearwardly extended from said valve flap to coaxial with said front valve stem, wherein said compression spring is mounted within an inner hole of said rear valve stem at a position that one end of said compression spring is supported by a bottom face of said inner slot of said air intake valve seat and an opposed end of said compression spring is supported by said valve flap of said control valve core.

12. The water tank-less toilet flushing system, as recited in claim 11, wherein said front valve stem is loosely coupled at a valve inner hole of said outlet water valve seat, and said rear valve stem is loosely coupled at said inner slot of said air intake valve seat, wherein said rear valve stem has a plurality of rear valve through holes communicating an interior of said rear valve stem with and exterior thereof, and said front valve stem has a plurality of front valve through holes communicating with an interior of said front valve stem with an exterior thereof.

13. The water tank-less toilet flushing system, as recited in claim 12, further comprising a front sealing ring sleeved at a front ring groove formed a root portion of said front valve stem and a rear sealing ring sleeved at a rear ring groove formed at a root portion of said rear valve stem, wherein when said compression spring is expanded to move said valve flap, said front sealing ring is sealed at said outlet water valve seat, and when said compression spring is compressed to move said valve flap, said rear sealing ring is sealed at said air intake valve seat.

14. The water tank-less toilet flushing system, as recited in claim 1, wherein said check valve is a pressure-controlled check valve selected from a group consisting of a positive pressure-controlled check valve, negative pressure-controlled check valve, and zero pressure-controlled check valve.

15. The water tank-less toilet flushing system, as recited in claim 1, wherein said control system further comprises a controller operatively linked to said check valve, wherein said check valve is water pressure sensor for detecting the water pressure within said water pipe, wherein said water pressure sensor sent a high electric level to a water pressure signal input terminal of said controller when there is a water pressure in said water pipe to enable said flush valve to be opened for starting a flushing operation of said flushing system, wherein said water pressure sensor sent a low electric level to said water pressure signal input terminal of said controller when there is no water pressure in said water pipe to prohibit said flush valve to be opened.

16. The water tank-less toilet flushing system, as recited in claim 2, wherein said control system further comprises a controller operatively linked to said check valve, wherein said check valve comprises a first electro-controlled valve and a second electro-controlled valve, wherein inlets of said first and second electro-controlled valves are communicated with the ambient atmosphere, wherein an outlet of said first electro-controlled valve is linked to said outlet of the first solenoid valve, wherein an outlet of said second electro-controlled valve is linked to said outlet of said second solenoid valve, wherein said water pressure sensor sent a high electric level to a water pressure signal input terminal of said controller when there is a water pressure in said water pipe to close said first and second electro-controlled valves for starting a flushing operation of said flushing system, wherein said water pressure sensor sent a low electric level to said water pressure signal input terminal of said controller when there is no water pressure in said water pipe to open said first and second electro-controlled valves.

17. The water tank-less toilet flushing system, as recited in claim 2, wherein said control system further comprises a controller operatively linked to said check valve, wherein said check valve comprises an electro-controlled valve having an inlet communicating with the ambient atmosphere and an outlet linked to an throttle orifice which communicates with said water pipe, wherein said water pressure sensor sent a high electric level to a water pressure signal input terminal of said controller when there is a water pressure in said water pipe to close said electro-controlled valve for starting a flushing operation of said flushing system, wherein said water pressure sensor sent a low electric level to said water pressure signal input terminal of said controller when there is no water pressure in said water pipe to open said electro-controlled valve for communicating said water pipe with the ambient atmosphere through said throttle orifice.

18. The water tank-less toilet flushing system, as recited in claim 1, wherein said control system further comprises a controller operatively linked to said check valve, wherein said check valve comprises a pressure-controlled switch having a main signal terminal electrically linked to an electric supplying circuit in series connection, wherein said electric supplying circuit is electrically linked between a power source and said controller, wherein said main signal terminal of the pressure-controlled switch is closed when there is a water pressure in said water pipe to open said flush valve for starting a flushing operation of said flushing system, wherein said main signal terminal of the pressure-controlled switch is opened when there is no water pressure in said water pipe to cut off an electrical power of said controller.

19. The water tank-less toilet flushing system, as recited in claim 1, wherein said control system further comprises a controlling switch and a controller operatively linked to said check valve, wherein said check valve comprises a pressure-controlled switch having a main signal terminal electrically linked to a control circuit in series connection, wherein said control circuit is electrically linked between said controlling switch and said controller, wherein said main signal terminal of the pressure-controlled switch is closed when there is a water pressure in said water pipe to open said flush valve via said controlling switch for starting a flushing operation of said flushing system, wherein said main signal terminal of the pressure-controlled switch is opened when there is no water pressure in said water pipe to cut off an electrical power of said controller to prevent said controlling switch being actuated.

20. The water tank-less toilet flushing system, as recited in claim 2, wherein said control system further comprises a controlling switch and a controller operatively linked to said check valve, wherein said check valve comprises a pressure-controlled switch having a first main signal terminal electrically linked to a first control circuit in series connection and a second signal terminal electrically linked to a second control circuit in series connection, wherein said first control circuit is electrically linked between said first solenoid valve and said controller while said second control circuit is electrically linked between said second solenoid valve and said controller, wherein said first and second main signal terminals of the pressure-controlled switch are closed when there is a water pressure in said water pipe to open said first and second solenoid valves via said controlling switch for starting a flushing operation of said flushing system, wherein said first and second main signal terminals of the pressure-controlled switch are opened when there is no water pressure in said water pipe to cut off an electrical power of said controller to prevent said controlling switch being actuated.

* * * * *